US006806015B2

(12) United States Patent
Haneda et al.

(10) Patent No.: US 6,806,015 B2
(45) Date of Patent: Oct. 19, 2004

(54) IMAGE FORMING METHOD USING FLATTENED SPHEROIDAL TONER

(75) Inventors: Satoshi Haneda, Tokyo (JP); Hiroshi Yamazaki, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/066,505

(22) Filed: Jan. 31, 2002

(65) Prior Publication Data

US 2002/0106574 A1 Aug. 8, 2002

(30) Foreign Application Priority Data

Feb. 6, 2001 (JP) ..... 2001-029413
Feb. 28, 2001 (JP) ..... 2001-054234
Mar. 2, 2001 (JP) ..... 2001-057962

(51) Int. Cl.[7] ..... G03G 15/20
(52) U.S. Cl. ..... 430/124; 430/45; 430/110.3
(58) Field of Search ..... 430/110.3, 110.1, 430/137.14, 124, 45

(56) References Cited

U.S. PATENT DOCUMENTS 4,948,692 A * 8/1990 Higashimura et al. ..... 430/126
5,328,795 A * 7/1994 Yamashiro et al. ..... 430/110.3

FOREIGN PATENT DOCUMENTS

JP 2000221814 A * 8/2000 ..... G03G/15/20

OTHER PUBLICATIONS

Borsenberer, Paul M. et al. Organic Photoreceptors for Imaging Systems. New York: Marcel–Dekker, Inc. (1993) pp. 6–17.*

* cited by examiner

*Primary Examiner*—Christopher Rodee
(74) *Attorney, Agent, or Firm*—Squire Sanders & Dempsey

(57) ABSTRACT

In an image forming method including the steps of: developing an latent image on an image forming body employing a developer of composed of flattened spheroidal toner particles; transferring the formed toner image onto a transfer material; and fixing the toner image on the transfer material, the flattened spheroidal toner particles satisfy the following conditions: $r_2/r_1$ falls within the range of 0.6 to 1.0; $d/r_2$ falls within the range of 0.1 to 0.5; $r_2$ is in the range of 5 $\mu$m to 20 $\mu$m; and $r_1$ falls within the range of 5 $\mu$m to 20 $\mu$m, where $r_1$ represents an average length of a major axis of each of the flattened toner particles, $r_2$ represents an average length of a minor axis of each of the flattened toner particles, and d represents an average thickness of each of the flattened toner particles.

25 Claims, 17 Drawing Sheets

FIG. 11 ( a )
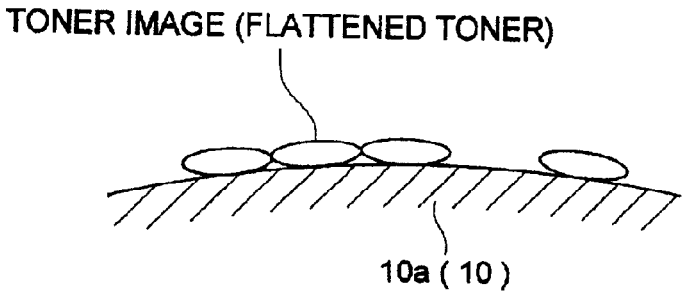
FIG. 11 ( b )
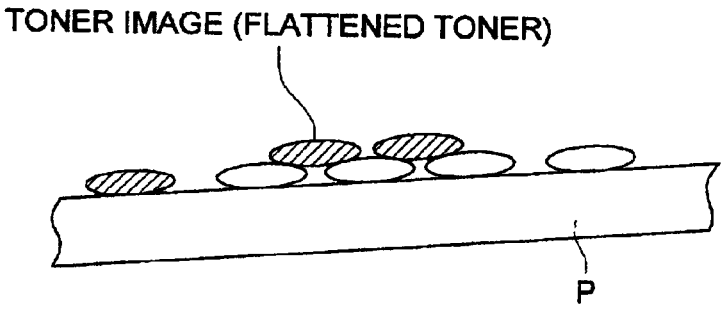
FIG. 11 ( c )
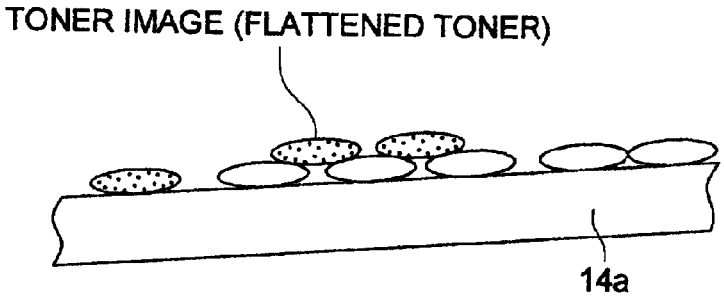

IMAGE FORMING METHOD USING FLATTENED SPHEROIDAL TONER

BACKGROUND OF THE INVENTION

The present invention relates to an image forming method using a toner composed of flattened spheroid particles (hereinafter referred to simply as flattened toner) as a toner of a two-component developer or a single-component developer for use in a copying machine, a printer, etc.

An image which is formed by using a toner produced by a usual pulverization method or polymerization method does not become a good glossy image owing to ruggedness produced on the surface resulted from the large amount of toner consumed; therefore, it has been difficult to obtain a high-quality image. Further, in the transfer process, the toner layer becomes thick because of the large amount of toner consumption to make the transfer ratio low; therefore, it has been impossible to obtain a high-density image, and occurrence of toner scattering has been making it impossible to obtain a good image.

Up to now, in order to obtain a printing-like, high-quality image, it has been made the attempt that the amount of toner consumption is made small by making the particle diameter of the toner smaller, to eliminate the ruggedness on the image surface to obtain a uniform gloss; however, because the covering power of the toner was lowered with the particle diameter of the toner being made smaller, a sufficient image density has not been able to be obtained, and because image forming processes such as development, transfer, and cleaning of the photoreceptor became difficult, a high-quality image has not been obtained by an image forming method based on electrophotography. Further, if toner particles having such a small particle diameter as 2 to 3 $\mu$m are used, in the case where an operator inhale the toner particles, there is a risk that he suffers from a disease such as pneumoconiosis; therefore, it is not preferable from the view point of safety and sanitation.

When a color image (having a printed area ratio of 25%) is formed by superposing color toner images by an electrophotographic method using spherical-shaped or indefinite-shaped color toners having a particle diameter of about 5 $\mu$m, which does not cause pneumoconiosis etc., the amount of toner consumption is about 90 mg per print sheet of A-4 size, and a thick toner layer is to be processed in development, transfer, and fixing. For this reason, scattered toner particles are observed in the toner image, and ruggedness is produced on the image surface, to make the difference in gloss between a toner deposition area and the background area; that is, it is the present state of the art that an image having a high image quality cannot be formed.

Further, the present invention relates to an image forming apparatus comprising a fixing device for use in a copying machine, a printer, a FAX machine, etc., and in particular, to an image forming apparatus capable of making fixing performance better by using a flattened toner in the developer.

Because an image formed by an image forming apparatus which forms a toner image on an image forming member using a toner composed of spherical-shaped or indefinite-shaped particles produced by a usual pulverization method or polymerization method, and then transfers the toner image onto a transfer material, to fix it, by an image forming apparatus which superposes toner images on an image forming member to form a color toner image composed of the toner images superposed on the image forming member, and then transfers the toner images all at a time, to fix them, by an image forming apparatus which transfers sequentially onto an intermediate transfer member toner images which have been formed on an image forming member in each of image forming units using a toner having a varied color for each, to form a color toner image composed of the toner images superposed on the intermediate transfer member, and then transfers the toner images on the intermediate transfer member all at a time, to fix them, or by the like, produces ruggedness on the image surface owing to the large amount of toner consumption, it has been difficult to obtain a printing-like image quality. Further, because of a large amount of toner consumption, toner layer became thick to make the transfer ratio low; therefore, a high-density image could not be obtained, and toner scattering occurred to make it impossible to obtain a good image. Especially, this problem became remarkable in the case of a color toner image composed of toner images superposed, and also fixing performance was bad.

In order to solve the above-mentioned problems, the inventors of this application has been attempting to make a toner layer thinner and flat, and in particular, to make a layer of superposed color toners thinner and flat; however, owing to the disturbance of the flattened toner particles in fixing (disturbance of the toner image), if a toner image is fixed under high pressure (Especially for a color toner image composed of toner images superposed, because it has a thick toner layer, the toner disturbance is remarkable, and higher pressure is necessary.), it is posed a problem that toner particles are crushed and spread to produce a disturbance of image, and because it is necessary to broaden the width of the nip portion owing to the spread of toner particle crushing (for a color toner image composed of toner images superposed, it is necessary to make the width of the nip portion broader owing to the layer thickness being made thicker), also it is posed a problem that warm-up time becomes longer.

SUMMARY OF THE INVENTION

The present invention has been proposed in view of the above-mentioned points of problem, and it is its object to provide an image forming method using a toner composed of flattened particles to be used with a carrier in a two-component developer or as a single component developer to make it possible to obtain a high-density image even with a small amount of toner consumption and to make it possible to obtain a high-quality image with little ruggedness and without toner scattering.

(1) It is the first object of the present invention to provide an image forming method in which flattened toner particles are deposited on an image forming member or a transfer member in such a way that the toner layer may be made thinner by taking into account the posture of the toner particles being deposited, and development, transfer, and fixing are performed satisfactorily.

(2) The second object of the present invention is to provide an image forming method in which, as a result of it that attention is paid to it that, by using an external additive of the flattened toner, the state of charge distribution on the flattened toner particles is improved to give a proper amount of fluidity, an external additive having a proper charging property is added to the toner, to make development, transfer, and fixing performed satisfactorily.

(3) The third object of the present invention is to provide an image forming method in which, as a result of it that attention is paid to it that, in adding an external additive to a flattened toner, it is extremely effective to select suitably the relation between the size of toner particles and the particle diameter of the external additive, an external additive having a suitable particle diameter is added to make development, transfer, and fixing performed satisfactorily.

(4) The fourth object of the present invention is to provide an image forming method in which, as a result of it that attention is paid to it that if there is a dispersion not smaller than a certain limit in the size and shape of the flattened toner, a good image cannot be obtained, a flattened toner which has been subjected to a suitable treatment and sorting in the manufacturing process of the toner is used, to make it possible to obtain an image having a high image quality.

(5) The fifth object of the present invention is to provide an image forming method in which, as a result of it that attention is paid to it that if there is a dispersion in the flat shape of the flattened toner, a good image cannot be obtained, the dispersion in the flattening ratio is limited to a proper amount, to make it possible to obtain an image having a high image quality.

(6) The sixth object of the present invention is, by solving the above-mentioned point of problems, to provide an image forming apparatus comprising a fixing device which prevents the generation of toner disturbance at the time of fixing, and prevents the generation of image disturbance owing to the spread of toner particle crushing, while the shortening of warm-up time is enabled by making the width of the nip portion narrower.

The object of the present invention is accomplished by an image forming method comprising: developing an electrostatic latent image on an image forming body employing a developing agent to form a toner image; transferring the toner image formed on the image forming body onto a transfer material; and fixing the toner image on the transfer material by a fixing device, wherein flattened toner particles which satisfy the following conditions are used as the developing agent: $r_2/r_1$ is not less than 0.6 and not more than 1.0; $d/r_2$ is not less than 0.1 and not more than 0.5; $r_2$ is not less than 5 $\mu$m and not more than 20 $\mu$m; and $r_1$ is not less than 5 $\mu$m and not more than 20 $\mu$m, wherein $r_1$ represents an average length of a major axis of each of the flattened toner particles, $r_2$ represents an average length of a minor axis of each of the flattened toner particles, and d represents an average thickness of each of the flattened toner particles.

The first object of the present invention is accomplished by, as a preferable structure, an image forming method for carrying out development of a latent image on an image forming member using a two-component developer composed of a toner and a carrier or a single-component developer, and transfer and fixing of the formed toner image to a transfer member, characterized in that said toner particles have a flattened shape, and the particles attach to the surface of the image forming member or the transfer member in such a way that the surface of the spheroid-shaped particle enlarged and flattened by crushing in the direction perpendicular to the surface to be flattened (hereinafter referred to simply as flattened portion of the particle) is in contact with the surface of said image forming member or transfer member.

The second object of the present invention is accomplished by, as a preferable structure, an image forming method for carrying out development for depositing toner particles on a latent image portion of an image forming member using a two-component developer composed of a flattened toner and a carrier or a single-component developer composed of a flattened toner, characterized in that development is done by the particles of said toner with an external additive attached, the charge quantity Q' ($\mu$C/g) of the toner particles with the external additive attached is related to the charge quantity Q ($\mu$C/g) of the toner particles having no external additive attached by an inequality $$|Q'|>|Q|,$$

and the toner particles make the attachment to the surface of the image forming member or the transfer member with the flattened portion kept in contact with the surface.

The third object of the present invention is accomplished by, as a preferable structure, an image forming method for carrying out development for depositing toner particles on a latent image area of an image forming member using a two-component developer composed of a flattened toner and a carrier or a single-component developer composed of a flattened toner, characterized in that development is done by the particles of said toner with an external additive attached, said development being carried out in such a way that the flattened portion of the toner particle is attached to the surface of the image forming member, and the particle diameter p of the external additive is related to the diameter r of the flattened portion and the thickness d of the toner particle by an equation $$p/r=10^{-1}-5\times10^{-3}.$$

The fourth object of the present invention is accomplished by, as a preferable structure, an image forming method for carrying out development, using a two-component developer composed of a flattened toner and a carrier or a single-component developer composed of a flattened toner, to make the flattened portion of the toner particles attach to a latent image area of an image forming member, characterized in that said toner is a flattened toner prepared by flattening processing of a spherical polymerization toner, and the particle diameter distribution of the spherical polymerization toner having a particle diameter do for use in the preparation of said flattened toner is such that not less than 80% of the particles fall within the range expressed by $$\tfrac{1}{2}<d_0/d_0(M)<2,$$

where $d_0(M)$ denotes the average of the particle diameter distribution.

The fifth object of the present invention is accomplished by, as a preferable structure, an image forming method for carrying out development, using a two-component developer composed of a flattened toner and a carrier or a single-component developer composed of a flattened toner, to make the flattened portion of the toner particles attach to a latent image portion of an image forming member, characterized in that the distribution of the ratio of the thickness d of said flattened toner and the diameter r of the flattened portion (flattening ratio) is such that not less than 80% of the particles fall within the range $$\tfrac{1}{2}<(d/r)/(d/r)(M)<2,$$

where (d/r)(M) denotes the average of the flattening ratio.

The above-mentioned sixth object is accomplished by, as a preferable structure, an image forming apparatus, which forms an electrostatic latent image on an image forming member, to form toner image on said image forming apparatus, and after that, transfers said toner image onto a transfer material, to fix said toner image on said transfer material by a fixing device, characterized in that a flattened toner is employed for said toner, and by means of said fixing device, an electric field to cause the particles of said flattened toner to be brought in a flattened state on the surface of said transfer material, while the particles of the flattened toner attached onto said transfer material in a flattened state where the flattened portion is in contact with the surface of the transfer material are fixed onto said transfer material under the application of pressure.

Further, the above-mentioned sixth object is accomplished by, as an another preferable structure, an image forming apparatus which forms an electrostatic latent image on an image forming member, to form a toner image by developing said electrostatic latent image with a developer including a toner, and after repeating the formation of said toner image to form a color toner image composed of said toner images superposed on said image forming member, transfers said toner images composing the color toner image on said image forming member onto a transfer material all at a time, to fix the color toner image on said transfer material by means of a fixing device, characterized in that a flattened toner is employed for said toner, and by means of said fixing device, an electric field to cause the flattened toner particles to be brought in a flattened state on the surface of said transfer material, while the particles of the superposed flattened toners attached on said transfer material in a flattened state where the flattened portion is in contact with the surface of the transfer material are fixed onto said transfer material under the application of pressure.

Further, the above-mentioned sixth object of the present invention is accomplished by, as a still another preferable structure, an image forming apparatus which forms an electrostatic latent image on an image forming member, to form a toner image by developing said electrostatic latent image with a developer including a toner, and having a plurality of image forming unit for forming said toner image on said image forming member arranged on an intermediate transfer member, sequentially transfers the toner images formed on said image forming members respectively by using respective toners having a varied color for each image forming unit to the intermediate transfer member, to form a color toner image composed of toner images superposed on said intermediate transfer member, and then transfers said toner images composing the color toner image on said intermediate transfer member onto a transfer material all at a time, to fix the color toner image on said transfer material by means of a fixing device, characterized in that a plurality of flattened toners are employed for said plurality of flattened toners respectively, and by means of a fixing device, an electric field to cause the particles of said flattened toners to be brought in a flattened state on the surface of said transfer material, while the particles of the superposed flattened toners attached onto said transfer material in a flattened state where the flattened portion is in contact with the surface of the transfer material are fixed onto said transfer material under the application of pressure.

BRIEF DESCRIPTION OF THE DRAWINGS

FIG. 11(*a*) to FIG. 11(*c*) are drawings showing toner images on an image forming member or on an intermediate transfer member;

DETAILED DESCRIPTION OF THE PREFERRED EMBODIMENT (1) A toner for use in the present invention is a flattened spheroidal toner whose particles are formed in such a way that spherical-shaped resin particles are crushed; in FIG. 1, a schematic drawing of a particle of a flattened toner is shown. In FIG. 1, $r_1$ denotes the major axis, $r_2$ denotes the minor axis, and d denotes the thickness of a flattened toner particle. The expression $(r_1+r_2)/2$ is called a diameter r of the flattened portion, and d/r is called a flattening ratio.

Figure 1:
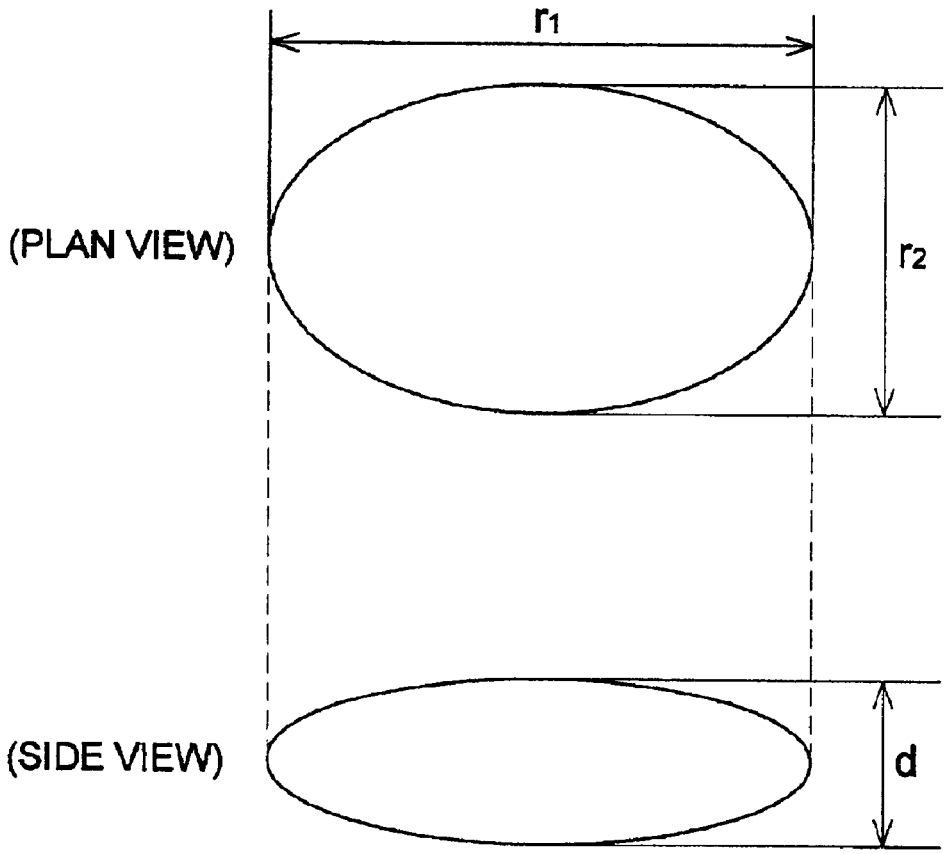
FIG. 1 is a schematic drawing showing an example of a particle of a flattened toner.

The volume-average particle diameter of a flattened toner to be used in the present invention is preferably 3 to 10 $\mu$m, and more preferably, 4 to 9 $\mu$m.

It is preferable that the flattened toner particles have a specified shape. That is, it is preferable that the average lengths, which are the major axis ($r_1$) and the minor axis ($r_2$) of the cross-section perpendicular to the crushing direction of the average particle in a flattened toner, are both 5 to 20 $\mu$m, and the average thickness (d) is 1 to 5 $\mu$m. The ratio of the minor axis to the major axis ($r_2/r_1$) of the average cross-section is preferably 0.6 to 1.0, and more preferably, 0.8 to 1.0. The ratio of the average thickness of the toner particles and the average minor axis ($d/r_2$) is preferably 0.1 to 0.5, and more preferably, 0.2 to 0.4.

If the average lengths ($r_1$, $r_2$) of a flattened toner are smaller than 5 $\mu$m, there is a possible risk of an operator suffering from a disease such as pneumoconiosis, which is not preferable from the view point of safety and sanitation; if it exceeds 20 μm, developing performance is lowered, and development of high fidelity cannot be carried out to lower the resolution of the developed image, which is not preferable.

If the average thickness (d) of a flattened toner is smaller than 1 μm, the flattened toner particles are broken during development to produce super-fine particles, which becomes the cause of producing toner scattering and background density; this is not preferable. If it exceeds 5 μm, the toner particles are difficult to deposit layer-wise in developing, to make the toner layer thicker, and the amount of toner consumption becomes larger, which is not preferable.

If the ratio of the average thickness to the average minor axis ($d/r_2$) of a flattened toner is not greater than 0.2, and in particular, smaller than 0.1, the flattened toner particles are broken during development, and super-fine particles are produced, which is not preferable to become the cause of producing toner scattering and gray background. If it is not smaller than 0.4, and in particular, if it exceeds 0.5, the flattened portion of the toner becomes difficult to attach facing the image forming member, the toner particles are difficult to deposit layer-wise, and the toner layer becomes thick, which makes the amount of toner consumption larger; these are not preferable. Further, also in transfer and fixing processes, toner scattering and the scattering of toner particles become remarkable, which is not preferable.

Figure 2:
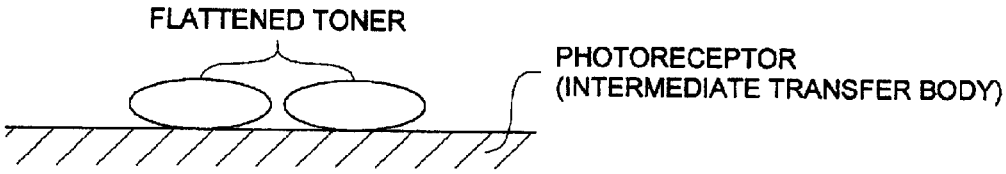
FIG. 2(*a*) to FIG. 2(*d*) are illustrations showing the states of particles of a flattened toner being attached respectively.
Figure 2:
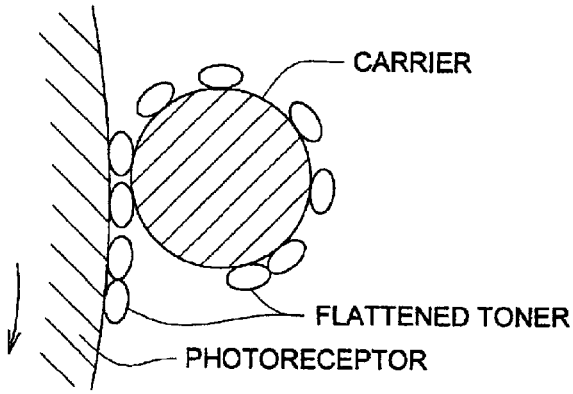
Figure 2:
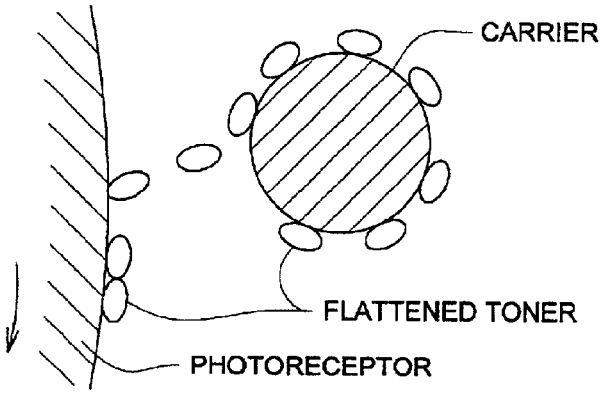
Figure 2:
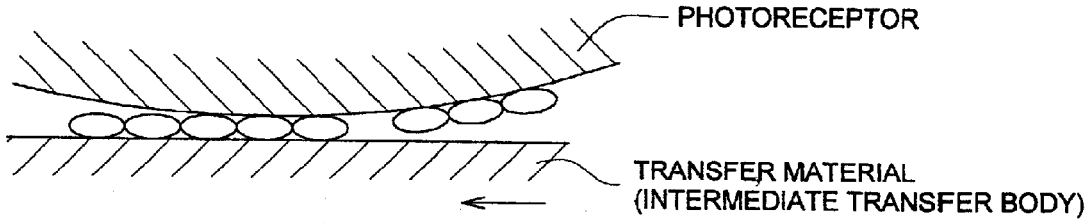

(2) The flattened toner particles explained in the above are charged by frictional charging between carrier particles to be described later to have the flattened portion charged; therefore, as shown in FIG. 2(*a*), for a toner supporting member such as an image forming member or an intermediate transfer member, the flattened toner particles are arrayed end by end in the lateral direction with their end portions laid down and the flattened portions attached to the toner supporting member by Coulomb's force. Because the repulsive force in the lateral direction between toner particles is weak, the state of attachment is stable with the particles being arrayed on the toner supporting member.

Because the repulsive force of the flattened toner particles in the state of attaching to the image forming member is strong in the vertical direction, toner particles are difficult to overlap one another in development, to form a thin toner layer. For the toner image formed by development, neither toner scattering nor spreading of toner image occurs also during transfer and fixing. FIG. 2(*b*) shows the posture of flattened toner particles during contact development; the flattened toner particles having moved to a development region with their flattened portion attached to the carrier particle make the flattened portions rub the photoreceptor (image forming member), and move to a latent image area as they keep the flat posture. The removing (developing) of the flattened toner particles is carried out under an electric field caused by the application of a DC bias voltage; in contact development using a flattened toner, superposed application of an AC bias voltage is especially effective because it assists the development.

FIG. 2(*c*) shows the posture of flattened toner particles in non-contact development; under a bias voltage composed of a DC voltage with an AC component superposed, the flattened toner particles having moved to a development region with their flattened portion attached to the carrier particle are made to leave the carrier particle by the applied development bias voltage, and fly towards a latent image area of the photoreceptor. During flying, the flattened toner particles take the posture of longitudinal direction by air resistance, and when they attach to the surface of the photoreceptor, they make vibratory motion under the AC bias voltage to keep a stabilized flat posture to make the flattened portion become into contact with the photoreceptor; in this way, development is carried out.

FIG. 2(*d*) shows the posture of flattened toner particles during transfer; because the toner image (layer) formed on the photoreceptor is flat and the repulsive force in the lateral direction of the attached toner is weak, transfer is carried out in a high fidelity with their flat posture kept as it is. In addition, because the toner particles attached to the surface of the photoreceptor with their flattened portion brought in contact with the surface, the electrical attachment force is large and the thickness of the toner layer is small; therefore, transfer before the transfer region is unlikely to occur, and transfer is carried out only in the transfer region; besides, the toner disturbance does not occur.

Figure 3:
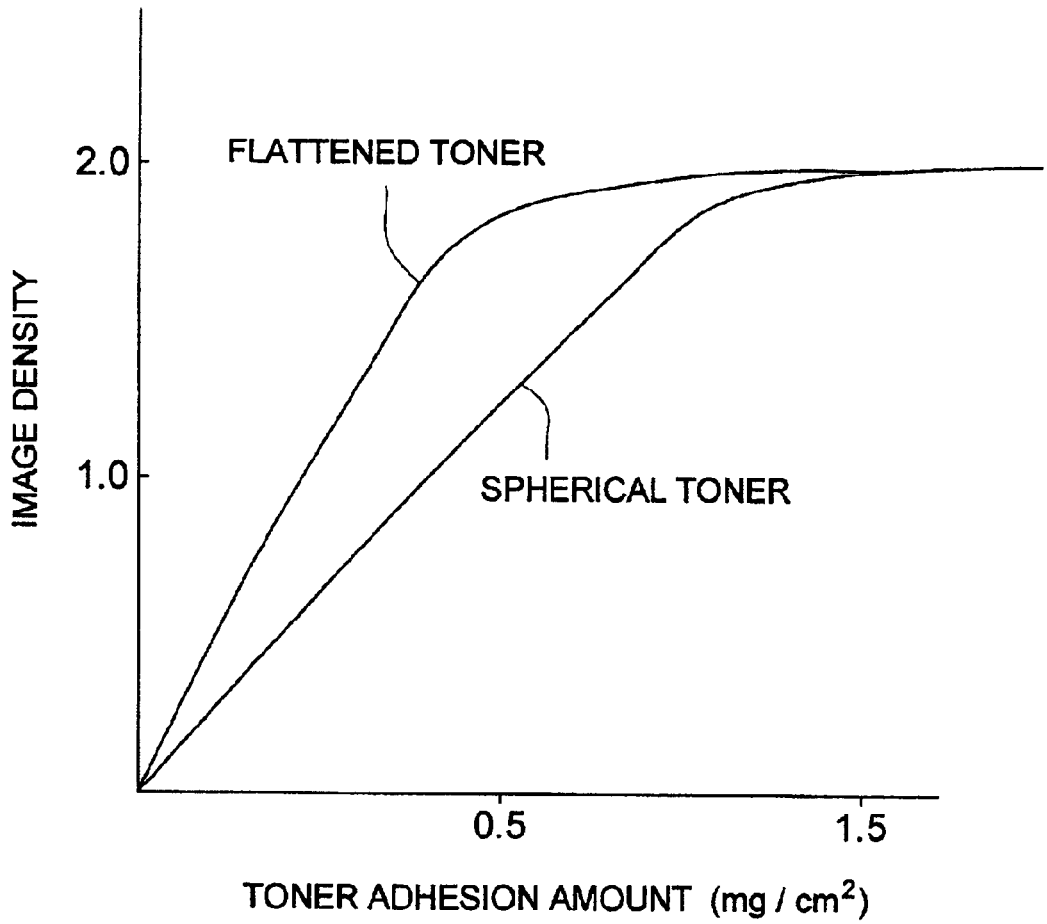
FIG. 3 is a graph for explaining the relation between the amount of toner deposition and the image density.

When development is carried out using a flattened toner, the toner particles on the photoreceptor is unlikely to overlap one another, to form a thin toner layer. As the result, the flattened toner give an image of the same density with a less amount of toner consumption as compared to the case where a spherical toner is used. FIG. 3 is a graph showing a relation between toner deposition quantity and image density. For example, if a spherical toner having an average particle diameter of 7 μm is used, image density comes nearly to a saturation value with a toner deposition quantity of about 0.8 $mg/cm^2$. In contrast with this, in the case of a flattened toner having the average shape factors of flattening ratio (d/r) 0.2 to 0.5 and diameter of flattened portion (r) 4 to 10 μm, the image density comes to a saturation value with a toner deposition quantity of 0.2 to 0.5 $mg/cm^2$. In the case where a flattened toner having average shape factors of the diameter of flattened portion (r) 7 μm and the thickness (d) 3 μm is used, approximately a single layer of toner particles is formed with a toner deposition quantity of 0.4 $mg/cm^2$ to, make image density reach a saturation value. With the flattening ratio of the used flattened toner being made smaller, the toner deposition quantity required for obtaining the image density of a saturation value decreases. Besides, in development using a flattened toner, 1 to 1.5 layers are sufficient for the toner layer to be formed on a photoreceptor, and if it is thicker, repulsion between toner particles occurs, to make the degradation of image quality recognized.

(3) Concerning the flattened toner explained in the above, how to manufacture the flattened toner (flattened particles) will be explained concretely.

A flattened toner for use in the present invention can be manufactured by the following process: Resin particles having a number-average primary particle diameter of 10 to 500 nm prepared by a suspension polymerization or emulsion polymerization method are salted out and fused to adhere to one another to form secondary particles, and after that, an organic solvent, an aggregation agent, a polymerization catalyst, etc. are added to make polymerization; then, the secondary particles (spherical toner particles) which have been made spherical in the solution and has progressed to 80% of completion in polymerization are circulated in a pressurized narrow path as they are heated together with the solution, by which the shape of the particles is flattened; further, polymerization catalyst is added again to complete the polymerization.

The above-mentioned salting out and adhesion by fusing means that resin fine particles produced by polymerizing process are salted out by an aggregation agent, and the surplus dispersion agent, surfactant, etc. are removed, while the size of the resin particles is adjusted through fusing to adhesion by heat.

The flattening processing may be carried out after the polymerization is completed to 100%; however, it is preferable that the flattening processing is carried out, after the process of making the particles spherical has been done, in the state that the polymerization has progressed to 80% of completion, because the shape is made uniform.

The above-mentioned number-average primary particle diameter can be measured by the light scattering electrophoresis particle diameter measuring instrument "ELS-800" (manufactured by Ohtsuka Electronics, Inc.).

A volume-average particle diameter can be measured by the Coulter counter Model TA-2 or by the Coulter Multisizer (manufactured by Coulter Co., Ltd.).

As regards the salting out and fusing to adhesion, there is a method in which resin particles are mixed with a dispersion including a releasing agent, coloring agent, etc. which are necessary for the composition of a toner, or it is possible to employ a method in which resin particles having a number-average primary particle diameter of 10 to 500 nm prepared by a method to polymerize a monomer, in which the constituents of a toner such as a releasing agent, a coloring agent, etc. are dispersed, by emulsion polymerization, are salted out and fused to adhesion.

That is, a coloring agent, and as occasion demands, several kinds of constituents such as a releasing agent, a charge control agent, a polymerization initiator, etc. are added to a polymerizable monomer, and the several kinds of constituents are dissolved or dispersed in the polymerizable monomer by a homogenizer, a sand mill, a sand grinder, an ultrasonic dispersing machine, etc. This liquid having several kinds of constituents dissolved or dispersed in it is dispersed in an aqueous medium including a dispersion stabilizing agent to make oil drops having a desired size for a toner by using a homo-mixer, a homogenizer, or the like. After that, the dispersion is removed to a reaction apparatus having a stirring mechanism with a stirring blade attached, and polymerization reaction is made to progress by heating to 80% of completion, to make the oil drops spherical particles (spherical toner particles). Then, the dispersion is circulated through a pressurized narrow path in a heated state, which makes the shape flattened, and more polymerization catalyst is added to put forward the polymerization, finally to complete the polymerization. After the completion of polymerization, by removing the dispersion stabilizing agent, and filtering, washing, and drying the dispersion, flattened toner particles for use in an image forming apparatus of the present invention can be prepared.

For the polymerizable monomer to be used as one making the resin as a binder, for example, the following can be cited: styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene; methacrylic ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl-aminoethyl methacrylate, and dimethyl-aminoethyl methacrylate; acrylic ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate, olefins such as ethylene, propylene, and isobutylene; vinyl or vinylidene halides such as vinyl chloride, vinylidene chloride, vinyl bromide, vinyl fluoride, and vinylidene fluoride; vinyl esters such as vinyl propionate, vinyl acetate, and vinyl benzoate; vinyl ethers such as vinylmethyl ether, and vinylethyl ether; vinyl ketones such as vinylmethyl ketone, vinylethyl ketone, and vinylhexyl ketone; N-vinyl compounds such as N-vinylcarbazole, N-vinyl indole, N-vinyl pyrrolidone; vinyl compounds such as vinyl naphthalene, and vinyl pyridine; acrylate or methacrylate derivatives such as acrylonitrile, methacrylonitrile, and acryl amide. Among these, vinyl monomers can be used singly or in combination with one another.

Further, for the polymerizable monomer to compose the resin, it is more preferable to use ones having an ionic dissociable substituent group in combination with one another. For example, monomers having a substituent group such as a carboxil group, a sulfonic acid group, or a phosphate group, namely, acrylic acid, methacrylic acid, maleic acid, itaconic acid, cinnamic acid, fumaric acid, maleic acid monoalkyl ester, itaconic acid monoalkyl ester, styrene sulfonate, arylsulfosuccinic acid, 2-acrylamide-2-methylpropane sulfonate, acid-phosphooxyethylmethacrylate, 3-chloro-2-acid-phosphooxypropylmethacrylate, etc. can be cited.

Further, it is possible to make a resin having a bridge structure by using polyfunctional vinyl monomers such as divinyl benezene, ethyleneglycol dimethacrylate, diethyleneglycol dimethacrylate, diethyleneglycol diacrylate, triethyleneglycol dimethacrylate, triethyleneglycol diacarylate, neopentylglycol dimethacrylate, and neopentylglycol diacrylate.

These polymerizable monomers can be polymerized by using a radical polymerization initiator. In this case, an oil-soluble polymerization initiator can be used in a suspension polymerization method. For this oil-soluble polymerization initiator, the following can be cited: azo-group or diazo-group polymerization initiators such as 2,2'-azobis-(2,4-dimethylvaleronitrile), 2,2'-azobisisobutylonitrile, 1,1'-azibis(cyclohexane-1-carbonitrile), 2,2'-azobis-4-methoxy-2,4-dimethylvaleronitrile, and azobisisobutylonitrile; peroxide polymerization initiators such as benzoyl peroxide, methylethylketone peroxide, diisopropyl peroxicarbonate, cumene hydroperoxide, t-butyl hydroperoxide, di-t-butyl peroxide, dicumyl peroxide, 2,4-dichlorobenzoil peroxide, lauroyl peroxide, 2,2-bis-(4,4-t-butylperoxycyclohexil) propane, tris-(t-butylperoxi)triazine; and high-molecular polymerization initiator having a peroxide in a side chain.

Further, in the case where emulsion polymerization method is used, a water-soluble radical polymerization initiator can be used. For the water-soluble polymerization initiator, persulfuric acid salt such as potassium persulfate, and ammonium persulfate, azobisaminodipropane acetate, azobiscyanovaleric acid and its salt, and hydrogen peroxide can be cited.

For the dispersion stabilizing agent, calcium tertiary phosphate ($Ca_3(PO_4)_2$), magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, etc. can be cited. Further, compounds which are generally used as surface active agents such as polyvinyl alcohol, gelatin, methylcellulose, sodium dodecylbenzenesufonate, an ethylene oxide-added substance, higher alcohol sodium sulfate can be used as a dispersion stabilizing agent.

For an excellent resin in the present invention, one having a glass transition temperature of 20 to 90° C. is preferable, and one having a softening point of 80 to 220° C. is preferable. A glass transition temperature can be measured by the differential thermal analysis method, and a softening point can be measured by a flow tester. Further, for this resin, one having a molecular weight, which is measured by gel-permeation chromatography, falling within a range as a number-average molecular weight (Mn) of 1,000 to 100,000 and as a weight-average molecular weight (Mw) of 2,000 to 1,000,000 is preferable. Further, in respect of molecular weight distribution, a resin having the ratio Mw/Mn from 1.5 to 100 is preferable, and in particular, the ratio from 1.8 to 70 is more preferable.

A flattened toner to be used in the present invention includes at least a resin and a coloring agent, and as occasion demands, it may include a releasing agent as a fixing performance improving agent, a charge control agent, etc. For the coloring agent to be used in a flattened toner for use in the present invention, carbon black, a dye, a pigment, etc. can be arbitrarily used.

For the carbon black, channel black, furnace black, acetylene black, thermal black, lampblack, etc. can be used.

For the dye, C. I. solvent red 1, C. I. solvent red 49, C. I. solvent red 52, C. I. solvent red 58, C. I. solvent red 63, C. I. solvent red 111, C. I. solvent red 122, C. I. solvent yellow 19, C. I. solvent yellow 44, C. I. solvent yellow 77, C. I. solvent yellow 79, C. I. solvent yellow 81, C. I. solvent yellow 82, C. I. solvent yellow 93, C. I. solvent yellow 98, C. I. solvent yellow 103, C. I. solvent yellow 104, C. I. solvent yellow 112, C. I. solvent yellow 162, C. I. solvent blue 25, C. I. solvent blue 36, C. I. solvent blue 60, C. I. solvent blue 70, C. I. solvent blue 93, C. I. solvent blue 95, etc. can be used, and moreover, a mixture of these can be also used. For the pigment, C. I. pigment red 5, C. I. pigment red 48:1, C. I. pigment red 53:1, C. I. pigment red 57:1, C. I. pigment red 122, C. I. pigment red 139, C. I. pigment red 144, C. I. pigment red 149, C. I. pigment red 166, C. I. pigment red 177, C. I. pigment red 178, C. I. pigment red 222, C. I. pigment orange 31, C. I. pigment orange 43, C. I. pigment yellow 14, C. I. pigment yellow 17, C. I. pigment yellow 93, C. I. pigment yellow 94, C. I. pigment yellow 138, C. I. pigment green 7, C. I. pigment blue 15:3, C. I. pigment blue 60, etc. can be cited. The above-mentioned dyes and pigments can be used singly or as a mixture of two or more. The number-average primary particle diameter of the coloring agent is diversified in accordance with the kind, and generally speaking, 10 to 200 nm is preferable.

For the method of adding a coloring agent, for example, a method in which a coloring agent is added in the stage of polymerizing the monomer, to make colored particles when polymerization is finished. In addition, in the case where a coloring agent is added in the stage to prepare a polymer, it is preferable to use it after the surface of the coloring agent particles is treated by a coupling agent in order that the radical polymerization function of the monomer may not be hindered by the coloring agent.

Further, it is appropriate to add low molecular weight polypropylene (the number-average molecular weight=1,500 to 9,000) or low molecular weight polyethylene, etc. as a fixing performance improving agent.

For the charge control agent too, several kinds of the agents which are known to public and can be dispersed in water can be used. To state it concretely, a dye belonging to the Nigrosine group, metal salt of naphthenic acid or higher fatty acid, alkoxylamine, quaternary ammonium salt compound, metal complex belonging to azo-group, metal salt of salicilic acid or its metal complex, etc. can be cited.

Besides, it is preferable-that the particles of these charge control agent and fixing performance improving agent have number-average primary particle diameter of 10 to 500 nm in a dispersed state.

The flattening of the secondary particles which have been made spherical through salting out and fusing to adhesion can be carried out by an annular-type continuous stirring mill of a wet method, a piston-type high-pressure homogenizer, or a inline screw pump, for example.

Figure 4:
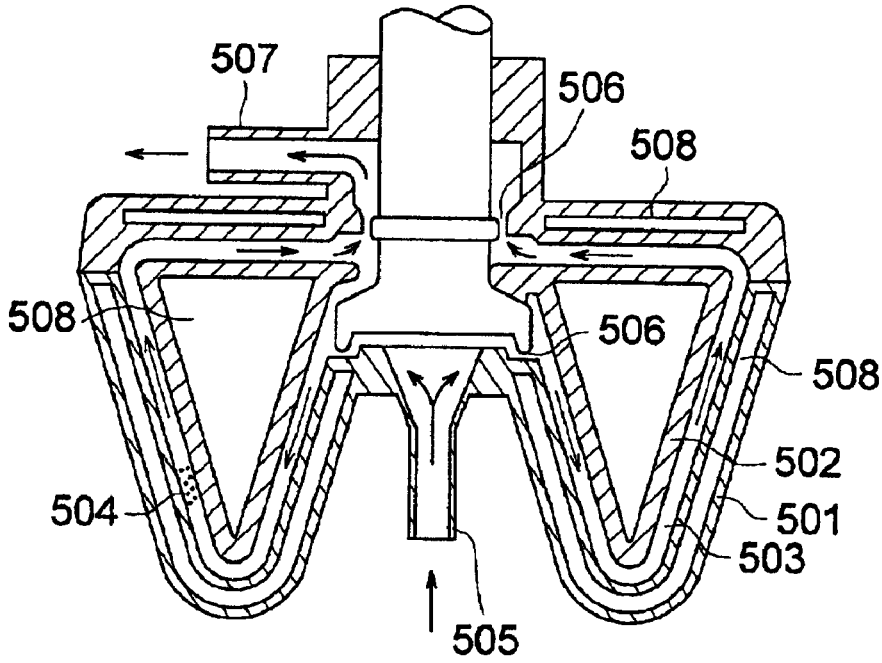
FIG. 4 is a cross-sectional view showing the essential portion of an example of an annular-type continuous stirring mill of a wet method.

As an example of it is shown in FIG. 4, the annular-type continuous stirring mill of a wet method is a kind of already known mill; in an annular-type (ring-shaped) stator 501 having a triangular cross-section, a rotor 502 having nearly the same shape rotates, and the clearance with a narrow width between the stator 501 and the rotor 502, namely, the cracking zone 503 is filled up with a medium 504, which applies a mechanical impulsive force to the secondary particles in the solution, which are supplied to the mill and has progressed to 80% of completion in polymerization, together with the solution including the secondary particles, to make the shape of the secondary particles spherical. Said solution moves from a supply opening 505 throughout said cracking zone having a W-shaped cross-section, and is separated from the medium 504 by the cap separator 506 at the top position, to be discharged from the exit 507. Further, the temperature control of the solution during the flattening processing is done by circulating warm water 508 throughout the stator and rotor. The medium 504 is moved sequentially through the W-shaped cracking zone by a centrifugal force, and comes back to the entrance, to circulate again. The pressure to the particles is applied from the wall of the cracking zone or from the medium by its circulating in the pressurized narrow path. For the medium, usually zircon, glass, or steel beads having a diameter of 0.5 to 3 mm are used.

The temperature of the solution including the secondary particles for the flattening processing using the above-mentioned annular-type continuous stirring mill of a wet method is preferably −5° C. to +40° C. with respect to the glass transition temperature of the resin of the secondary particles, and more preferably, 0° C. to +30° C. If the processing is carried out at a temperature lower than the glass temperature by 5° C. or more, the cracking of the polymerized particles occurs, which is not preferable to make it difficult to perform the flattening to aim at. On the other hand, if the processing is carried out at a temperature higher than the glass transition temperature by 40° C. or more, the secondary particles get fused to adhere to one another to produce aggregated blocks, and the flattened polymer particles are made truly spherical again by their surface tension, which is not preferable because flattening cannot be performed efficiently.

(4) It is recognized that a flattened toner prepared by the above-mentioned manufacturing method has a considerable amount of dispersion in the size and shape. If a flattened toner having a considerable amount of dispersion, the toner cannot exhibit an excellent effect which a proper flattened toner has. However, it is not easy to select flattened toner particles which fall within a range of allowed dispersion from a flattened toner having a considerable amount of dispersion in the size and shape. The inventors recognized it very effective to perform selection for the spherical secondary particles in the manufacturing process explained in the above or to regulate the condition of particle diameter distribution in the process of preparation. In the case where the spherical-shaped secondary particles has larger diameters, flattening can be done easily by a later processing, but if they have smaller diameters, flattening is difficult; therefore, in the case where the secondary particles have a dispersion in the particle diameter, a flattened toner having a dispersion not only in the size but also in the shape.

According to the present invention, by using spherical resin particles for the mother material and making the particle diameter distribution narrow, the particle diameter distribution of the toner which has been subjected to flattening processing is made not to spread; according to the result of an experiment, it was recognized that the particle size distribution of the spherical secondary particles as the mother material which are to be used in preparing a flattened toner and have a particle diameter do should be such one that not less than 80% of the particles are required to have a diameter falling within a range expressed by $$\frac{1}{2}<d_0/d_0(M)<2,$$

where $d_0(M)$ denotes the average of the particle size distribution. Further, it was found a preferable condition that the particle size distribution of the spherical-shaped secondary particles should be such one that not less than 95% of the particles have a diameter falling within a range expressed by $$\frac{1}{4}<d_0/d_0(M)<4.$$

In addition, for the average of the particle size distribution $d_0(M)$, it represents the average particle diameter of spherical-shaped resin particles from 4 to 9 $\mu$m.

As regards exhibiting the excellent effect of a flattened toner, the dispersion of shape cannot be neglected. The most important factors in the shape of a flattened toner are the thickness d, the diameter r of the flattened portion, and the flattening ratio (d/r). The distribution of the flattening ratio (d/r) of a flattened toner must be such one that not less than 80% of the particles have a flattening ratio falling within a range expressed by $$\frac{1}{2}<(d/r)/(d/r)(M)<2,$$

and it is preferable that not less than 95% of the particles have a flattening ratio falling within a range expressed by $$\frac{1}{4}<(d/r)/(d/r)(M)<4.$$

A flattened toner satisfying the above-mentioned condition can exhibit the excellent property which a proper flattened toner owns.

(5) It is widely employed that an external additive is made to exist on the surface of toner particles for the reasons of enhancing the fluidity, improving the transfer performance, etc. This can be said also in respect of a flattened toner, and especially concerning a flattened toner, because the effect to make uniform the charge distribution on the toner particle surface cannot be neglected, it is necessary to add an external additive.

As regards the composition of the external additive, one in a mixed state of particles having a larger particle diameter and particles having a smaller particle diameter is used.

As for the larger particle diameter, it is 50 to 1500 nm in number-average primary particle diameter. The above-mentioned number-average primary particle diameter means such that is measured by observing 100 particles enlarged 2,000 times by a transmission-type electron microscope and analyzing the image.

The primary particle diameter is 50 to 1,500 nm and preferably 60 to 1,000 nm; if it is smaller than this range, the spacer effect is lowered, and if it is larger, detachment of the particles occurs. It is preferable that the surface of the primary particles is made hydrophobic.

For the material, any one kind of particles out of inorganic fine particles, organic fine particles, and complex fine particles may be employed. As preferable particles, inorganic fine particles of titania, zirconia, alumina, silica, etc. can be cited. As for the organic and complex fine particles, styrene-acrylic resin particles and styrene-acrylic resin particles made complex with titania can be cited respectively.

As regards the smaller particle diameter, it is 5 to 40 nm in number-average primary particle diameter. The above-mentioned number-average primary particle diameter means such that is measured by observing 100 particles enlarged 2,000 times by a transmission-type electron microscope and analyzing the image.

The primary particle diameter is 5 to 40 nm and preferably 5 to 30 nm; if it is smaller than this range, the embedding of particles owing to a mechanical stress is enhanced to lower the durability of fluidity-giving effect, and if it is larger, the fluidity-giving effect is lowered. It is preferable that the surface is made hydrophobic.

For the material, inorganic fine particles can be cited. Preferable inorganic particles are titania, zirconia, alumina, and silica particles. It is preferable that the amount of addition of the external additive to a flattened toner satisfies the following conditions:

External additive of larger particle diameter:

0.1 to 5.0% by weight of the toner,

External additive of smaller particle diameter:

0.1 to 5.0% by weight of the toner,

Ratio of addition quantity:

larger particles: smaller particles=1:0.3 to 1.5 (weight ratio),

Coverage ratio:

surface coverage ratio is 40% to 100%, and preferably 50 to 10%.

The coverage ratio is calculated as a ratio of the sum of the lengths of the circumferential parts of a toner particle to which external additive particles adhere to the total circumferential length, measured by observing a sliced piece of a toner particle, which is treated with an external additive and enclosed by an epoxy resin, by a transmission-type electron microscope, and estimating the state of existence of the external additive particles adhering to the toner particle surface.

If the coverage ratio is small, the effect of the external additive cannot be exhibited, and further, if the coverage ratio exceeds 100%, free additive particles are produced to become the cause to bring about damage of the photoreceptor.

Besides, a coverage ratio of 100% or over means that a state where additive particles adheres to over the whole area of the circumferential surface of a toner particle, and on top of it, the external additive particles exist as multiple layers.

(6) The raw material to be used for an external additive will be explained in detail.

(a) Inorganic Fine Particles

For the material to compose inorganic external additive fine particles, various kinds of inorganic oxides, nitrides, borides, etc. can be suitably used. For example, silica, alumina, titania, zirconia, barium titanate, aluminum titanate, strontium titanate, magnesium titanate, zinc oxide, chromium oxide, cerium oxide, antimony oxide, wolfram oxide, tin oxide, tellurium oxide, manganese oxide, boron oxide, silicon carbide, boron carbide, titanium carbide, silicon nitride, titanium nitride, boron nitride, etc. can be cited. Further, ones that are subjected to a treatment for making hydrophobic the surface of the above-mentioned inorganic fine particles may be also appropriate. In the case where a treatment for making the surface hydrophobic (hereinafter referred to as hydrophobic treatment for simplicity's sake) is practiced, it is preferable to carry out the treatment by using so called a coupling agent such as any one of various kinds of titanium coupling agents, and a silane coupling agent, a silicone oil, or the like; further, it is preferably practiced to carry out the hydrophobic treatment by using a metal salt of a higher fatty acid such as aluminum stearate, zinc stearate, and calcium stearate.

(b) Examples of Treating Agent for Hydrophobic Treatment

For the titanium coupling agent, tetrabutyl titanate, tetraoctyl titanate, isopropyl-triisostearoil titanate, isopropyl-tridecilbenzenesulfonil titanate, bis (dioctylpyrophosphate) oxiacetatetitanate, etc. can be cited. Further, for the silane coupling agent, γ-(2-aminoethyl)aminopropyl-trimethoxisilane, γ-(2-aminoethyl)aminopropyl-dimethoxisilane, γ-methacryloxipropyl-trimethoxisilane, hydrochlorates of N-β-(N-vinylbenzilaminoethyl) γ-aminopropyltrimethoxisilane, hexamthyl-disilane, methyl-trimethoxisilane, butyl-trimethoxisilane, isobutyl-trimethoxisilane, hexil-trimethoxisilane, octyl-trimethoxisilane, decil-trimethoxisilane, dodecil-trimethoxisilane, phenyl-trimethoxisilane, o-methylphenyl-trimethoxisilane, p-methylphenyl-trimethoxysilane, etc. can be cited.

For the fatty acid and its metal salt, long-chain fatty acids such as undecil acid, lauric acid, tridecil acid, dodecil acid, myristic acid, palmitic acid, pentadecil acid, stearic acid, heptadecil acid, arachidic acid, montanic acid, oleic acid, linoleic acid, and arachidonic acid can be cited, and for the metallic salts, salts of metals such as zinc, iron, magnesium, aluminum, calcium, sodium, and lithium can be cited.

For the silicone oil, dimethyl-silicone oil, methylphenyl-silicone oil, amino-modified silicone oil, etc. can be cited.

As regards these compounds, it is appropriate that 1 to 10% by weight of the inorganic fine particles is added to cover the surface, and preferably, 3 to 7% by weight should be added. Further, these materials can be used in combination.

(c) Organic Fine Particles

For the organic fine particles, styrene resin particles, styrene-acrylic resin particles, polyethylene resin particles polyurethane resin particles, etc. can be cited.

In respect of resin fine particles, the composition is not to be limited. Generally speaking, organic fine particles belonging to the vinyl group are preferable. The reason of this is that vinyl fine particles can be easily manufactured by a manufacturing method such as emulsion polymerization method or suspension polymerization method. To state it concretely, styrene or styrene derivatives such as styrene, α-methylstyrene, p-chlorostyrene, 3,4-dichlorostyrene, p-phenylstyrene, p-ethylstyrene, 2,4-dimethylstyrene, and p-t-butylstyrene; methacrylic acid derivatives such as methyl methacrylate, ethyl methacrylate, n-butyl methacrylate, isopropyl methacrylate, and 2-ethylhexyl methacrylate; acrylic acid derivatives such as methyl acrylate, ethyl acrylate, isopropyl acrylate, n-butyl acrylate, t-butyl acrylate, isobutyl acrylate, n-octyl acrylate, and 2-ethylhexyl acrylate; olefins such as ethylene, propylene, and isobutylene; vinyl halide such as vinyl chloride, vinylidene chloride, vinyl bromide, vinyl fluoride, and vinylidene fluoride; vinyl esters such as vinyl propionate, and vinyl acetate; vinyl ethers such as vinylmethyl ether, and vinylethyl ether; vinyl ketones such as vinylmethyl ketone, vinylethyl ketone, and vinylhexyl ketone; N-vinyl compounds such as N-vinylcarbazole, N-vinyl indole, and N-vinyl pyrrolidone; vinyl compounds such as vinyl naphthalene, and vinyl pyridine; acrylic acid or methacrylic acid derivatives such as acrylonitrile, methacrylonitrile, acryl amide, N-butylacrylamide, N,N-dibutylacrylamide, methacrylamide, N-bytylmethacrylamide, and N-octadecilacrylamide can be cited. These vinyl monomers can be also used singly or in combination with one another.

As regards the manufacturing method of the resin fine particles, they can be manufactured by an emulsion polymerization method or a suspension polymerization method. The emulsion polymerization method is a method such that the polymerization is done after the above-mentioned monomer is added in water including a surfactant and is emulsified; for the surfactant, any one that is used as a surfactant such as sodium dodecilbenzenesulfonate, polyvinyl alcohol, an ethylene oxide-added substance, or higher alcohol sodium sulfate can be used, and there is no limitation. Further, also it is suitable what is called a no residual emulsifier polymerization method such as a method using a reactive emulsifying agent, polymerization method based on a hydrophilic monomer such as vinyl acetate or methyl acrylate using persulfate polymerization initiator, a method in which water soluble monomers are copolymerized, a method in which a water-soluble resin and an oligomer are used, a method in which a decomposition-type emulsifying agent is used, or a method in which a bridging-type emulsifying agent is used. For the reactive emulsifying agent, sulfonate of acrylic acid amide, salts of maleic acid derivatives, etc. can be cited. Because the soap free (non-emulsion) polymerization method is not influenced by the residual emulsifying agent, it is suitable in the case where one kind of organic particles is used singly.

For the polymerization initiator which is necessary for synthesizing resin fine particles, peroxides such as benzoyl peroxide and lauril peroxide, and azo polymerization initiators such as azobisisobutylonitrile and azobisisovaleronitrile can be cited. It is preferable that the addition quantity of these is 0.1 to 2% by weight of the monomer. If it is too less than this quantity, polymerization reaction is deficient, and the problem of monomer itself remaining left occurs. Further, if it is too more than this, the decomposition product of the polymerization initiator remains left to influence the charging property, and on top of it, because the polymerization reaction is too fast, it is posed the problem that the molecular weight of the polymer becomes smaller. Further, in emulsion polymerization method etc., potassium persulfate, sodium tiosulfate, etc. can be used for the polymerization initiator.

In respect of the external additive explained in the foregoing, for the inorganic fine particles, it is preferable to use inorganic oxide particles such as silica, titania, and alumina, and further, it is preferable that these inorganic fine particles are subjected to a hydrophobic treatment with a silane coupling agent, a titanium coupling agent, or the like. For the degree of the hydrophobic treatment, it is not to be limited particularly, but a hydrophobic property of 40 to 95 in methanol wettability is preferable. The word "methanol wettability" means an index to evaluate the wettability of the surface to methanol. In this method, inorganic fine particles as the object of measurement are weighed to obtain 0.2 g of them, which are added in distilled water of 50 ml contained in a beaker of the capacity 200 ml. Methanol drops are slowly dropped down from a burette whose end is dipped in the liquid as it is stirred slowly until the whole of the inorganic particles are wetted. When a (ml) denotes the quantity of methanol required for perfectly wetting the inorganic fine particles, the degree of hydrophobic-making is calculated from the following equation.

$$\text{Degree of hydrophobic-making}=(a/(a+50))\times 100.$$

It is preferable that the addition quantity of this external additive is 0.1 to 5.0% by weight of the flattened toner, and more preferably, it should be 0.5 to 4.0% by weight. Moreover, for the external additive, various kinds of compounds described in the above may be used in combination.

(7) When external additive particles are made to adhere to the surface of flattened toner particles to a coverage ratio of 40 to 100%, the non-uniformity of charge distribution on the toner particle surface is prevented, to make a uniform charge distribution, and in respect of the adhesion of the toner particles to the photoreceptor and transfer member, Coulomb's force becomes stronger at the flattened portions than the end portions, which causes the toner particle to adhere with one of the flattened portions brought in contact. Besides, it is necessary that the position of the external additive in the frictional charging series comes to the same side as that of the toner and the charge quantity of the flattened toner Q' ($\mu$C/g) in the case where the external additive particles adhere is related to the charge quantity of it Q ($\mu$C/g) in the case where no external additive particles adhere by the inequality $|Q|<|Q'|$. If $|Q'|$ is smaller than $|Q|$, because more external additive particles adhere to the flattened portion, the adhesion of the flattened toner particle based on the flattened portion become unstable. If the condition $|Q|<|Q'|$ is satisfied, the charge quantity becomes larger in the flattened portion, and the toner particle adheres with one of the flattened portions kept in contact with the object. Further, by adding an external additive, fluidity is also raised, which makes the charge distribution on the toner particle surface more uniform.

With respect to a toner which is negatively charged, an external additive composed of a material such as silica which is to be charged in the same polarity is preferable. The material of the external additive is selected in accordance with the charging characteristic of the toner. It is preferable that, by selecting the material of the external additive and raising the coverage ratio within a range not exceeding 100%, the charge quantity satisfies the following condition $$|Q'|/|Q|=1 \text{ to } 1.5.$$

Figure 5:
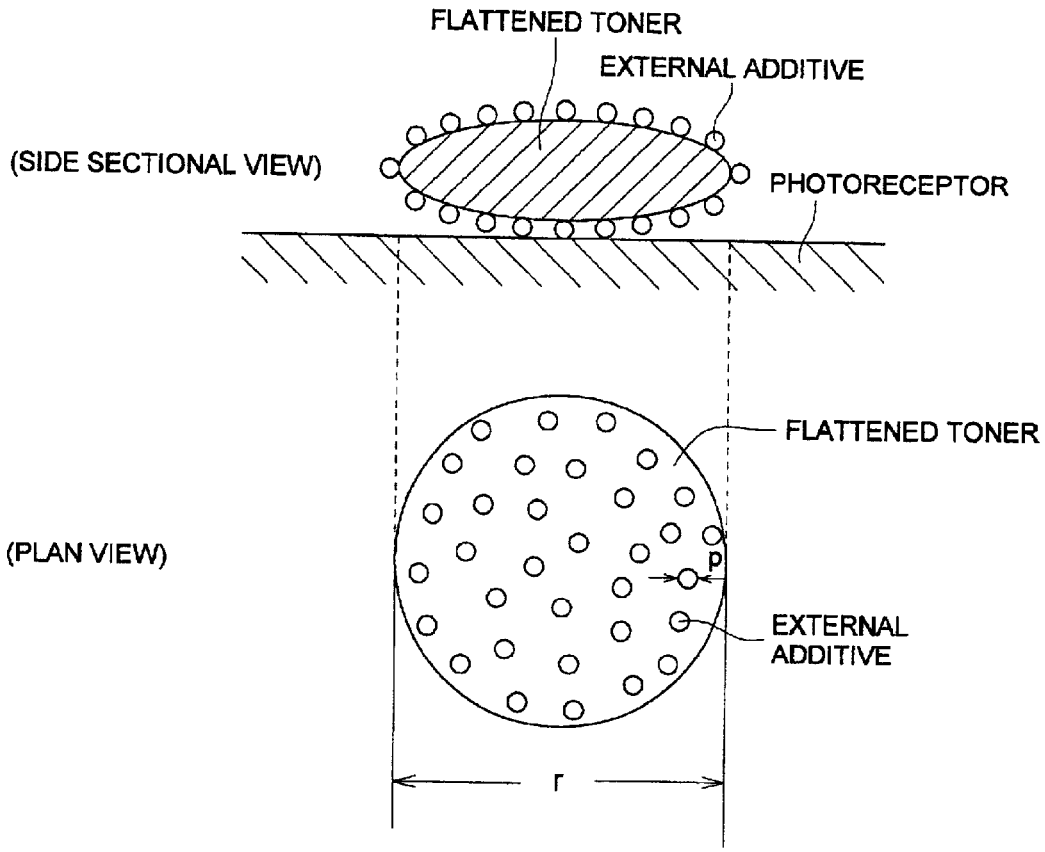
FIG. 5 is an illustration showing a state of particles of an external additive attaching to a particle of a flattened toner.

An external additive is used as a mixture of larger-diameter particles and smaller-diameter particles. The smaller diameter particles of the external additive are necessary for enhancing the fluidity and charging property, and the larger-diameter particles play a role of a spacer between the photoreceptor and the flattened toner particles to have an effect to improve transfer ratio and cleaning performance. It is remarkably improved by using an external additive composed of larger-diameter particles that a flattened toner is inferior to a spherical-shaped toner or a indefinite-shaped toner in transfer ratio and cleaning performance because of it having broader contact area with the photoreceptor as compared to the spherical- or indefinite-shaped toner. In FIG. 5, a state where larger-diameter particles of an external additive adhere to a flattened toner particle is shown.

According to a study of the inventors, it was found out that there is a conditional relation for an external additive composed of larger-diameter particles to function effectively as a spacer between the shape of a flattened toner and the particle diameter of an external additive composed of larger-diameter particles.

When r denotes the diameter of the flattened portion of a flattened toner, d denotes its thickness, and p denotes the particle diameter of an external additive, it is necessary that they satisfy the relation $$p/r=5\times 10^{-3} \text{ to } 10^{-1},$$

and preferably they satisfy the relation $$p/d=3\times 10^{-2} \text{ to } 3\times 10^{-1}.$$

If the particle diameter of an external additive deviates from the above-mentioned range, the external additive does not sufficiently fulfill the function as a spacer. The flattened toner explained in the above is used as a two-component developer with a carrier, and is charged by the friction with the carrier in the developing device; the flattened toner particles come to the development region as they adhere to the carrier particles, to carry out development.

(8) For the carrier as magnetic particles composing a two-component developer, materials, which are heretofore known to public, of metal such as iron, cobalt, or nickel, of metal oxide such as ferrite, or magnetite, and of alloy composed of one or more of these and aluminum, manganese, copper, etc. can be used. Among them, ferrite particles are especially preferable. As regards the above-mentioned magnetic particles, it is appropriate that the number-average particle diameter falls within a range of 15 to 100 $\mu$m, more preferably within a range of 25 to 60 $\mu$m. The number-average particle diameter of a carrier can be measured, in a representative way, by a particle diameter distribution measuring apparatus of a laser diffraction type provided with a dispersing device of wet type named "HELOS" (manufactured by SYMPATEC Co., Ltd.).

As regards the carrier, one coated with resin, or so-called a carrier of a resin-dispersed type which is composed of magnetic fine particles dispersed in resin is preferable. For the resin composition for coating, there is no particular limitation; however for example, olefin resin, styrene resin, styrene-acrylic resin, silicone resin, ester resin, fluorine-contained polymer resin, or the like can be used. Further, for the resin for composing the carrier of a resin-dispersed type, any one known to public can be used without particular limitation; for example, styrene-acrylic resin, polyester resin, fluorine-contained resin, phenol resin, etc. can be used. It is especially preferable that a magnetic carrier to be used in the present invention has a spherical shape or a flattened spheroid shape.

Generally speaking, if the magnetic carrier has a larger average particle diameter, there are posed problems, for example, that unevenness in the toner image, which is developed from an electrostatic latent image with the carrier particles being vibrated by an electric field, tends to appear, and that a high density development cannot be done owing to the magnetic developing brush having a lowered toner concentration. In order to solve these problems, it is appropriate to make the average particle diameter of the magnetic carrier particles smaller, and if the particle diameter of the magnetic carrier falls within a range of 20 to 90 $\mu$m, the above-mentioned problems do not occur.

If the particle diameter is smaller than 20 $\mu$m, it is difficult to magnetize the carrier particles sufficiently, and the carrier particles tend to attach to the surface of the photoreceptor drum together with the toner particles, or become easy to scatter.

Further, if the particle diameter is greater than 90 $\mu$m, because the specific surface area of the carrier particles become smaller, they cannot charge the toner particles sufficiently. Moreover, because the coverage ratio becomes higher, toner scattering tends to occur.

It is preferable that the carrier particles are formed of a magnetic particle to make the resistivity of the carrier particles as a whole $10^8$ Ω·cm or over, and in particular, $10^{12}$ Ω·cm or over. This resistivity is a value to be obtained by reading a value of an electric current to be produced when the particles are put into a container having a cross-sectional area of 0.50 $cm^2$ and are tapped, then a weight load of 1 $kg/cm^2$ are applied to the packed particles, and an electric voltage is applied to generate an electric field of 1000 V/cm between the load and the bottom electrode. If this resistance value is lower, electric charge is injected into the carrier particles when a bias voltage is applied to the developing sleeve to make the carrier particles tend to attach to the surface of the image carrying member, or to make the dielectric breakdown of the carrier easy to occur.

The strength of magnetization (maximum magnetization) of the carrier particles is 10 to 60 emu/g, and preferably 15 to 40 emu/g. In respect of this strength of magnetization, as it depends on the density of the magnetic developing brush on the developing sleeve, under the condition of a general density value of the magnetic developing brush on the developing sleeve, if it is smaller than 10 emu/g, magnetic constraining force does not act effectively, to cause carrier scattering to occur. Further, if it exceeds 60 emu/g, the height of the magnetic developing brush become too large for non-contact development, to make it difficult to keep them out of contact with the image carrying member. In a contact development, toner images tend to have streaks produced by brushing of the magnetic developing brush.

Further, as regards the absolute value of the charge quantity of the toner particles, because the toner particles move following the electric field, in a two-component developer, it is preferable to make it 15 to 40 $\mu$C/g from the view point of securing the developing capability and preventing the background density and toner scattering. Especially, in the case of a smaller particle diameter, a higher charge quantity is necessary.

Generally speaking, in a two-component developer, in the case where a usual coated carrier (having a packing density of 5 to 8 $g/cm^3$) is used, the toner concentration in a developer is 2 to 30% by weight, and preferably 2 to 20% by weight; if it is smaller than 2% by weight, the number of toner particles required for development cannot be secured, and the coverage ratio is lowered, which brings about the excess of charging and the lowering of developing density. Further, if it is greater than 30% by weight, the coverage ratio becomes larger, which makes poor charging and toner scattering tend to occur.

When a flattened toner of the present invention is used, it is necessary to make the coverage ratio to the carrier fall within a range of 40 to 80%. According to an observation by the inventors, in the case where the coverage ratio is 80% or under, as shown by the projection drawing in FIG. 6(*a*), a flattened toner particle charged frictionally adheres to a carrier particle having a spherical or flattened spheroid shape with the flattened portion brought in contact with the carrier, and toner particles repulse one another to adhere a little spaced from one another. Further, if the coverage ratio is lower than 40%, excess charging and lowering of developing density occur, although the posture of the toner particles adhering is the same.

Toner particles of a flattened toner adhering to a carrier particle with the flattened portion made in contact, move to the photoreceptor surface taking the posture such that the flattened portion is brought into contact with the photoreceptor surface by development; thus, development is done.

Figure 6:
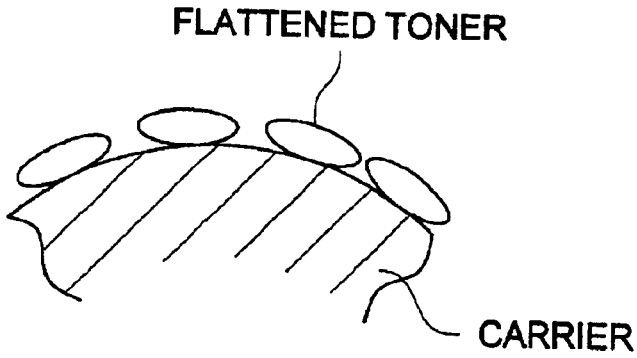
FIG. 6(*a*) and FIG. 6(*b*) are projection drawings showing states of particles of a flattened toner attaching to a carrier particle.
Figure 6:
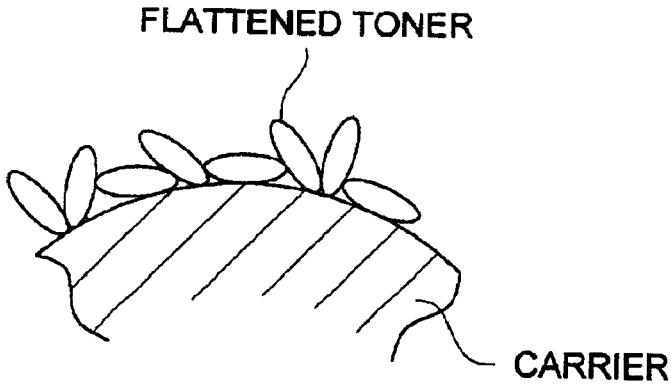

If the coverage ratio of a flattened toner to a carrier exceeds 80%, as shown by the projection drawing in FIG. 6(*b*), a state comes to occur where some toner particles adhere to the carrier surface with the end portion made in contact; it occurs a phenomenon that toner particles having charge on the end portions adhere to the photoreceptor with the one end portion brought into contact with its surface by development, which is not preferable.

(9) In cases where development is carried out using a two-component developer composed of a flattened toner and a magnetic carrier, in both cases of non-contact development land of contact development, an excellent developing performance is to be exhibited as compared to a development using a spherical-shaped toner.

Figure 7:
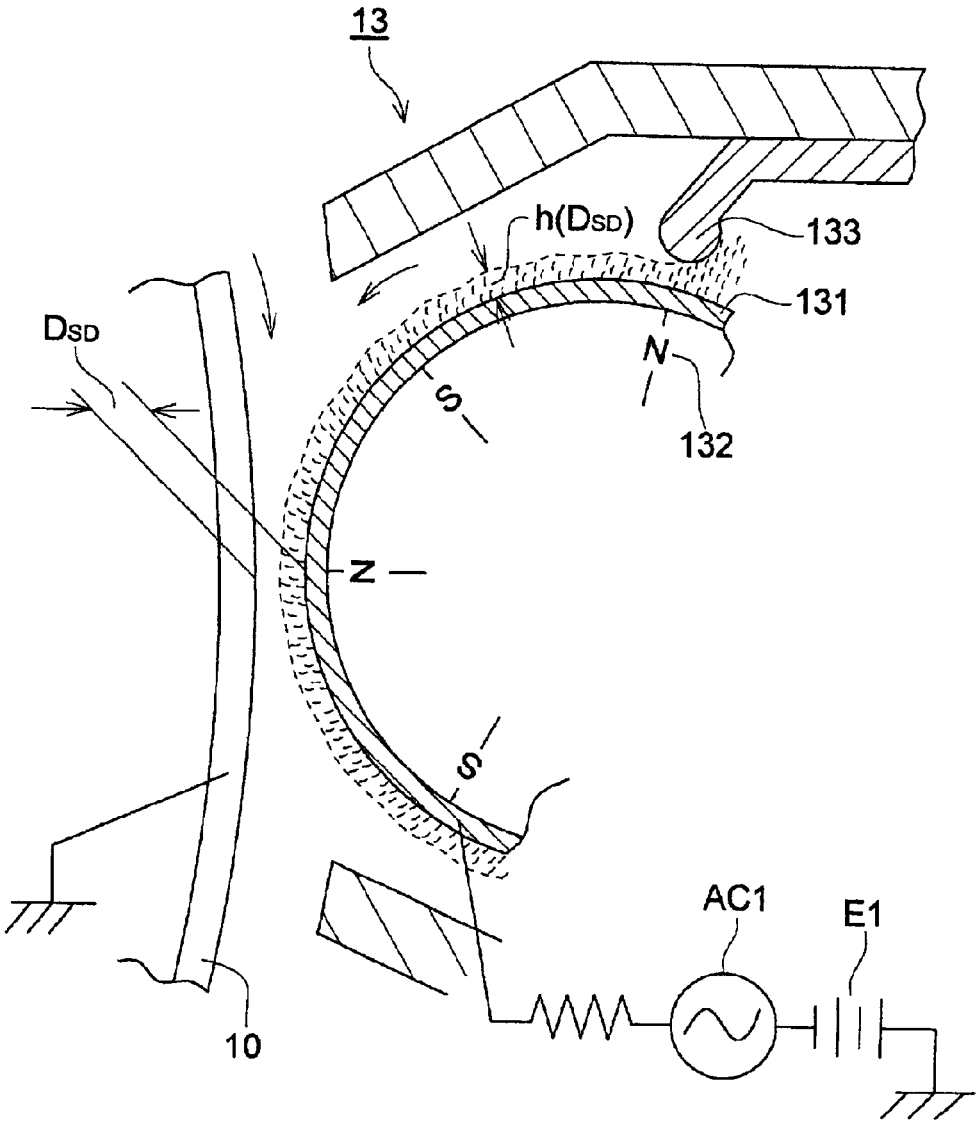
FIG. 7 is a cross-sectional view of the structure of a developing sleeve facing a photoreceptor drum.

FIG. 7 shows the cross-sectional structure of the developing sleeve 131 of a developing device 13 which is positioned opposite to a photoreceptor drum 10 as an image forming member.

The developing sleeve 131 as a developer carrying member is made up of a non-magnetic cylindrical-shaped member made of, for example, a stainless steel having an outer diameter of 8 mm to 60 mm, and is rotated in the direction with or against the moving direction of the photoreceptor 10 keeping a specified gap DSD to the circumferential surface of the photoreceptor 10 by a rolling spacer (not shown in the drawing) provided at the both ends of the developing sleeve 131. If the outer diameter is smaller than 8 mm, it is impossible to form a magnet roll comprising at least 5 magnetic poles consisting of the magnetic poles N1, S1, N2, S2, and N3 which are necessary for image formation. Further, if the outer diameter of the developing sleeve 131 exceeds 60 mm, the developing device 13 becomes large-sized. Especially, in a color printer comprising a plurality of sets of developing device 13, the volume occupied by the developing devices become large, which makes the outer diameter of the photoreceptor drum 10 larger, and makes the image forming apparatus larger-sized owing to the photoreceptor drum 10 being made larger-sized.

The circumferential surface of the developing sleeve 131 is subjected to a treatment for obtaining a surface roughness of 2 to 15 $\mu$m so as to improve the carrying capability for the developer.

The magnet roll 132 is included in the developing sleeve 131, has a plurality of magnetic poles of N and S arranged alternately, is fixed concentrically with the developing sleeve 131, and causes magnetic force to act on the circumferential surface of the non-magnetic sleeve.

It is necessary that the magnetic flux density on the circumferential surface of the developing sleeve falls within a range of 500 to 1200 gauss in order to hold the developer to form a magnetic brush.

The layer thickness regulating member 133 as a layer thickness regulating means is made up of, for example, a rod-shaped or plate-shaped magnetic stainless steel member which is positioned opposite to the magnetic poles of the magnet roll 132 and is disposed at a specified gap to the developing sleeve, and regulates the layer thickness of the two-component developer on the circumferential surface of the developing sleeve 131; the two-component developer having its layer thickness regulated is transported to the development region.

An electrostatic latent image on the photoreceptor 10 is reversely developed in a non-contact or contact state by a non-contact or contact developing method with a developing bias voltage composed of the direct-current (DC) bias E1 with the alternate-current (AC) bias AC1 superposed applied to the developing sleeve 131.

(Non-Contact Development)

In non-contact development, it is preferable that the gap DSD between the developing sleeve 131 and the photoreceptor drum 10 is set to a value falling within a range of 300 to 1,000 $\mu$m. If this gap is smaller than 300 $\mu$m, it becomes difficult to form a non-contact developer layer carrying out a uniform developing action, and on top of it, also it becomes impossible to supply enough toner to the development region; thus, it is brought about that a stable development is not carried out. On the contrary, if the gap exceeds 1,000 $\mu$m, the so-called opposite electrode effect is lowered, which causes a sufficient developing density not to be obtained. Further, by making the gap to have a value falling within a range of 300 to 1,000 $\mu$m, it becomes possible to form a non-contact developer layer having a suitable thickness uniformly. Therefore, it is put into practice that, by adjusting the thickness of a developer layer h ($D_{SD}$) for the developing gap $D_{SD}$ at the layer thickness regulating portion to become 0.5 $D_{SD}$ to 0.8 $D_{SD}$, the developing gap and the thickness of the developer layer is set to values satisfying the condition that the developer layer is not brought into contact with the surface of the photoreceptor drum 10, and as close as possible to it, under a condition of no oscillating electric field produced during a period of not forming an image. By doing it, it is prevented that grain in a toner image owing to the brushing is produced or that the background density is produced. It is preferable that the position of the developing sleeve 131 facing, close to the photoreceptor drum 10 is such that the direction of gravity is towards the developing sleeve 131, for the reason of preventing the scattering of toner particles etc.; but of course, it is not limited to this. Further, for the developing sleeve, the outer diameter of 10 to 30 mm is preferably used, and it is preferable that the speed and the direction of the rotation of the developing sleeve 131 is slow and against the moving direction of the photoreceptor drum 10, from the view point of preventing the scattering of toner particles etc; however, from the view point of image reproducibility of the developing layer, it is preferable that the rotating direction is with the moving direction of the photoreceptor drum 10, and the circumferential speed of the developing sleeve 131 is suppressed within 1.5 to 3.5 times the circumferential speed of the photoreceptor drum 10. However, it is not limited to this.

As regards the development under an oscillating electric field, it is preferable that the development is carried out by applying a bias voltage composed of a direct-current voltage relating to the prevention of background density and to the developing density with an alternate-current current voltage relating to the developing density and to the gradation characteristic superposed, and generating an oscillating electric field in the development region by the voltage. For the direct current component of the bias voltage, in reverse development, it is set at a value smaller than the accepted charge potential in the background area having no image of the photoreceptor drum 10 by about 100 to 200 V. For the alternate current component, a voltage falling within a range of the frequency 1 to 10 kHz and the amplitude $V_{PP}$ 1,500 to 3,000 V is used. The above-mentioned alternate current component of the bias voltage is not limited to a sinusoidal wave, but may be a rectangular wave, a triangular wave, etc. If the frequency of the alternate current component is too low, the pitch of oscillation appears in the developed image, and if it is too high on the contrary, it appears the tendency that the developer particles cannot comply with the oscillation of the electric field, which lowers the developing density and makes it impossible to reproduce a sharp high-quality image. Concerning the amplitude of the alternate current component $V_{PP}$, although it relates to the frequency too, the larger it is, the more the developer layer oscillates, and more toner particles are detached from the carrier particles to fly for development and the effect of the electric bias is increased with it; however, on the other hand, the larger it is, the more the background density tends to be produced and the easier dielectric breakdown such as a phenomenon of falling of a thunderbolt is to occur. However, if the carrier particles of the developer are insulated with resin or the like, the dielectric breakdown is prevented, and also the generation of the background density can be prevented by the direct current component of the bias voltage. Besides, the surface of the developing sleeve 131 may be insulated or half insulated with a resin or oxide film, and also it is put into practice that ruggedness is provided on the surface of the developing sleeve so as to improve its capability of transporting the developer layer. By using the above-mentioned developer and the developing conditions, it can be carried out non-contact development that is stable and produces an image having no background density and an excellent resolution.

Especially in non-contact development, in the case where a flattened toner is controlled in such a way that the toner particles adhere to the carrier particle with a coverage ratio falling within a range of 40 to 80%, toner particles, which have been electro-statically adhering to the carrier particle with the flattened portion as shown in FIG. 6(*a*) in the development region, are detached from the carrier particle by the applied electric bias voltage, and the flattened toner particles fly to adhere to the latent image area of the photoreceptor drum 10 with the flattened portion as shown in FIG. 2(*c*), and a development to deposit a thin layer giving a sufficient image density is carried out. In such a development, it is extremely effective to use an external additive explained in the foregoing, for raising the developing capability and forming a high-quality toner image of a thin layer.

(Contact Development)

In contact development, it is preferable that the developing gap $D_{SD}$ is set at a value falling within a range of 0.5 to 2.0 mm. In order to make the peak portions of the magnetic brush brought into frictional contact with the circumferential surface of the photoreceptor drum 10 over a suitable range, the thickness of the developer layer h ($D_{SD}$) to be regulated at the layer thickness regulating portion is adjusted to 1.5 $D_{SD}$ to 3.0 $D_{SD}$. By doing it, it is prevented that streaks of the toner image owing to the brushing is produced or that the background density is produced. It is preferable that the position of the developing sleeve 131 coming close to the photoreceptor drum 10 is such that the direction of gravity is directed towards the developing sleeve 131 for the reason of preventing the scattering of toner particles etc., but of course, it is not limited to this. Further, for the developing sleeve 131, the outer diameter of 10 to 30 mm is preferably used, and it is preferable that the speed and the direction of the rotation of the developing sleeve 131 is slow and against the moving direction of the photoreceptor drum 10, from the view point of preventing the scattering of toner particles etc; however, from the view point of image reproducibility of the developing layer, it is preferable that the rotating direction is with the moving direction of the photoreceptor drum 10, and the circumferential speed of the developing sleeve 131 is suppressed within 1.5 to 3.5 times the circumferential speed of the photoreceptor drum 10. However, it is not limited to this. In contact development too, it is practiced to apply a bias voltage composed of a direct-current voltage with an alternate-current voltage superposed to the developing sleeve 131. For the direct current component of the bias voltage, in reverse development, it is set at a value smaller than the accepted charge potential in the background area having no image of the photoreceptor drum 10 by about 100 to 200 V. For the alternate current component, a voltage falling within a range of the frequency 1 to 5 kHz and the amplitude $V_{PP}$ 500 to 1,500 V is used. In contact development too, by the application of an alternate current bias voltage, the development efficiency is raised owing to the effect of the oscillating electric field, and by releasing the aggregation of the developer and softening the magnetic brush, it is obtained the effect to eliminate the streaks of toner image owing to brushing. Moreover, it is prevented that an image is produced with toner particles made to get together towards the edge portion of the solid areas by the brushing of the magnetic brush which is in frictional contact with the latent image surface, and a good development to produce an image having a high density and no unevenness is carried out.

Also in contact development, in the case where a flattened toner is controlled in such a way that the toner particles adhere to the carrier particles with a coverage ratio falling within a range of 40 to 80%, toner particles included in a two-component developer electro-statically adhere to a carrier particle with the flattened portion as shown in FIG. 6(*a*), and in the development region, they are brought into frictional contact with the surface of the photoreceptor; by the application of the developing bias voltage, the flattened toner particles come to adhere to the latent image area of the photoreceptor drum 10 with the flattened portion as shown in FIG. 2(*b*), and a development to deposit a thin layer giving a sufficient image density is carried out. In such a development, it is extremely effective to use an external additive explained in the foregoing, for enhancing the developing capability and forming a high-quality toner image of a thin layer.

Figure 8:
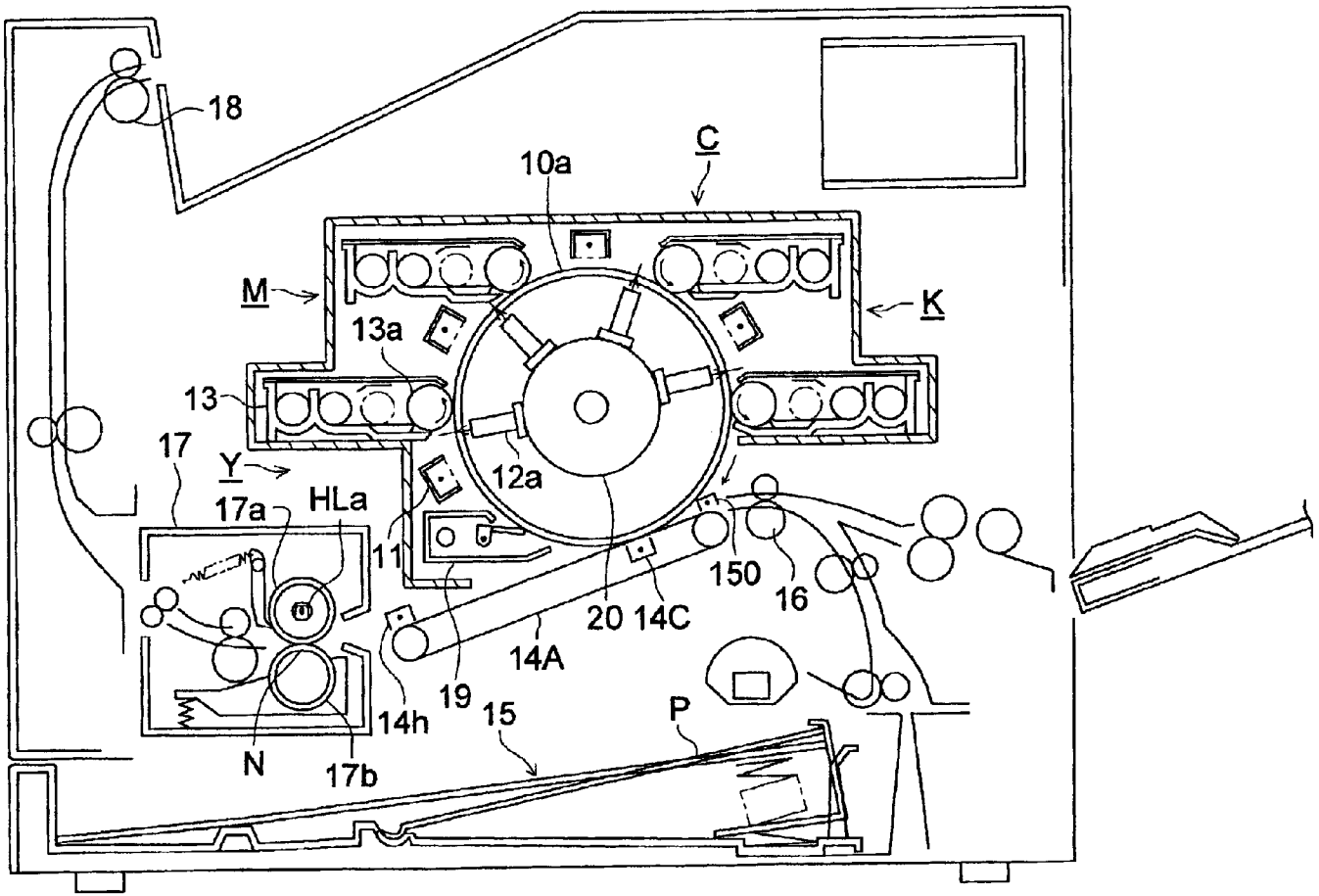
FIG. 8 is a cross-sectional view of the structure of an image forming apparatus (a first example) using a flattened toner.
Figure 9:
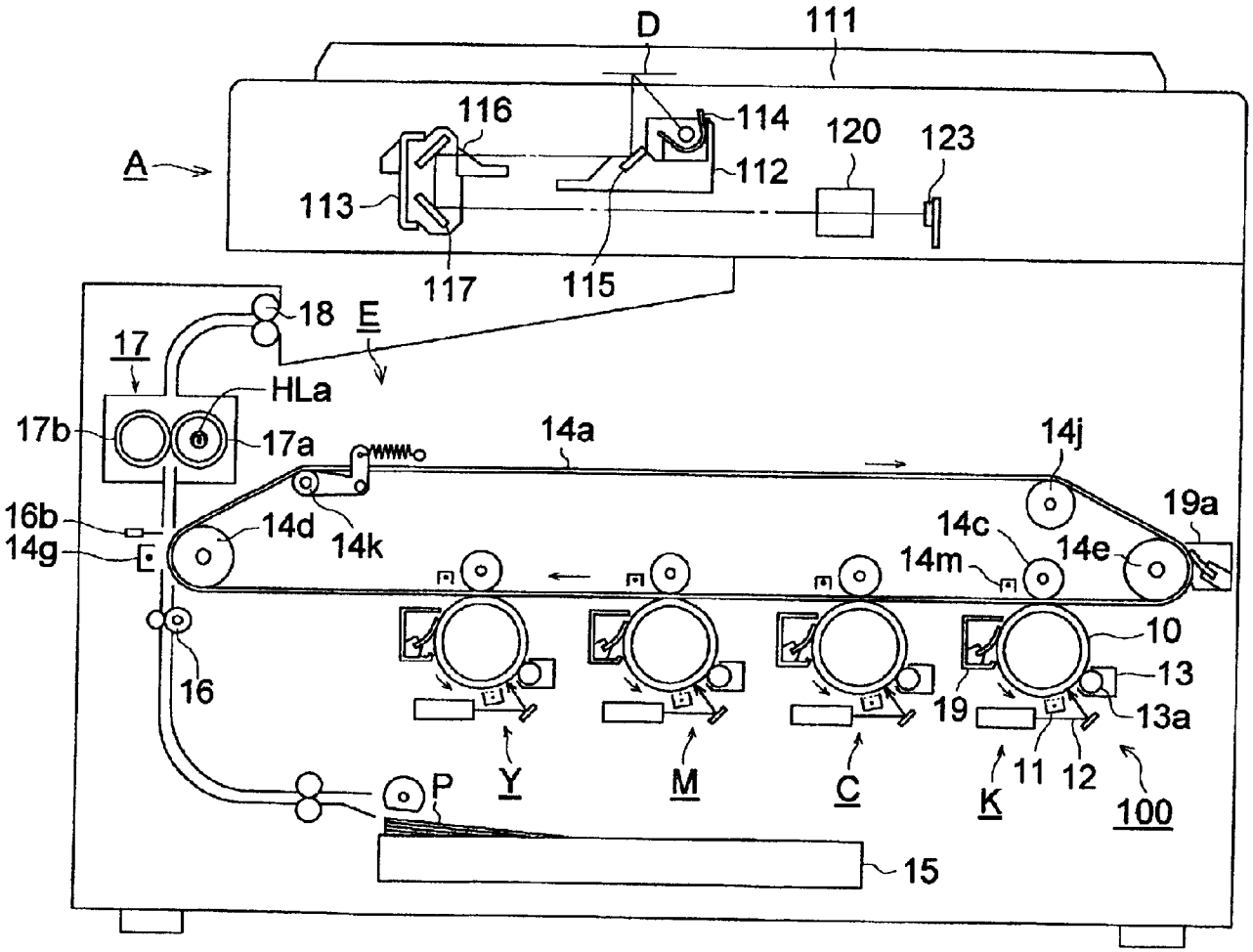
FIG. 9 is a cross-sectional view of the structure of an image forming apparatus (a second example) using a flattened toner.
Figure 10:
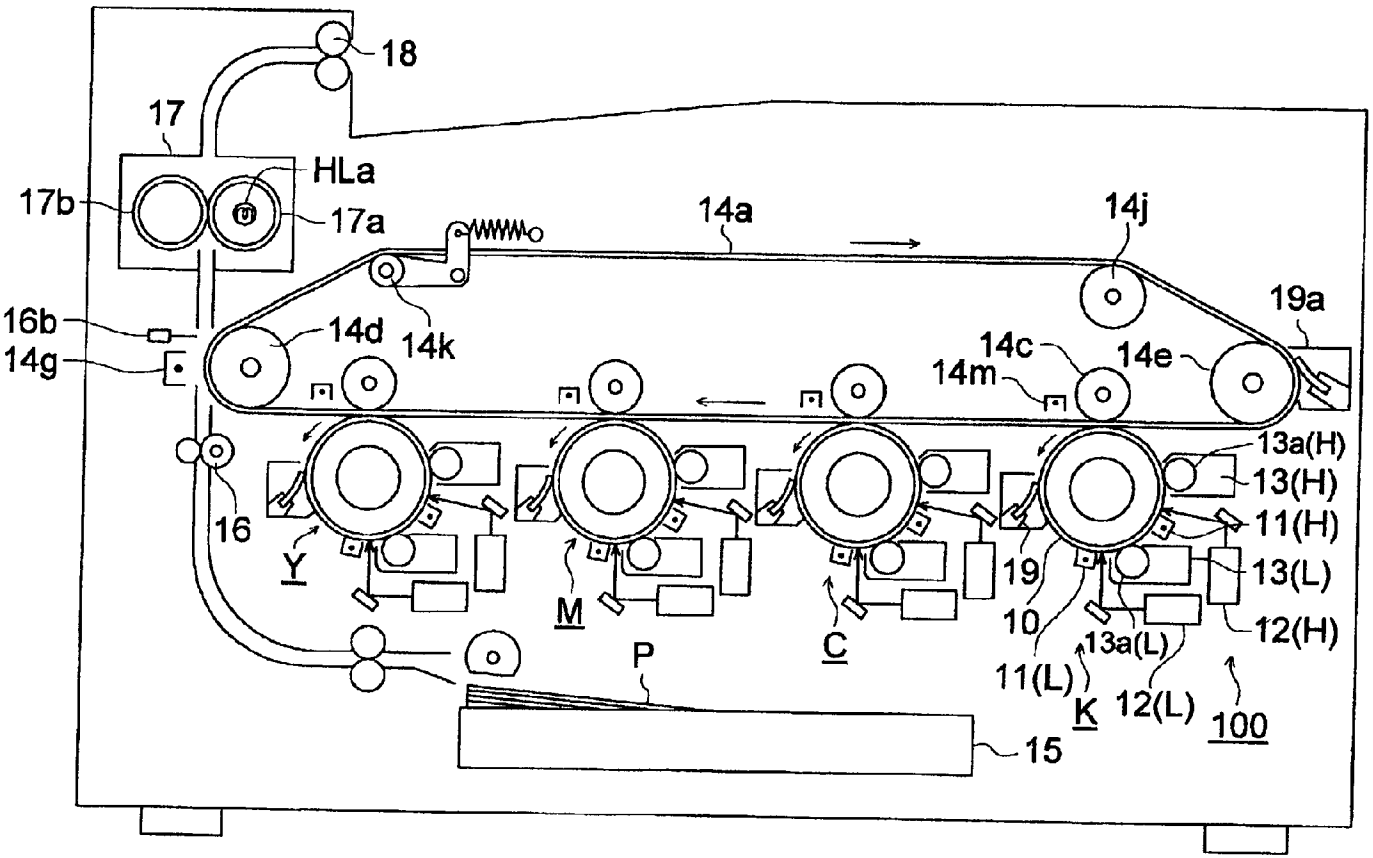
FIG. 10 is a cross-sectional view of the structure of an image forming apparatus (a third example) using a flattened toner.

(10) Each of examples of an image forming apparatus which practices development using a flattened toner in the developer explained in the above will be explained by using FIG. 8 to FIG. 11(*c*). FIG. 8 is a cross-sectional view of the structure of a color image forming apparatus showing a first example of the embodiment of an image forming apparatus using a flattened toner of the present invention, FIG. 9 is a cross-sectional view of the structure of a color image forming apparatus showing a second example of the embodiment of an image forming apparatus using a flattened toner of the present invention, FIG. 10 is a cross-sectional view of the structure of a color image forming apparatus showing a third example of the embodiment of an image forming apparatus using a flattened toner of the present invention, and FIGS. 11(*a*) to 11(*c*) are drawings showing toner images composed of flattened toner particles on an image forming member or on an intermediate transfer member.

In the image forming apparatus shown in FIG. 8, the photoreceptor drum 10*a* as an image forming member is composed of a light transmitting conductive layer and a photoconductive layer of an organic photosensitive layer (OPC) formed on the outer circumference of a cylindrical base member formed of a light transmitting material such as glass, acrylic resin, or the like.

The photoreceptor drum 10*a* is rotated in the clockwise direction shown by the arrow mark in FIG. 1 by a driving force from a drive source (not shown in the drawing) with the light transmitting conductive layer grounded.

It is appropriate that the exposure beam for image exposure to be used in this example of practice has a light quantity and a wavelength which are able to give a suitable contrast in accordance with the photo-decay characteristic of the photoconductive layer positioned at the image forming point of the beam on the photoreceptor drum 10*a*. For the material of the light transmitting base member, acrylic resin, in particular, one obtained by polymerizing methylmethacrylic acid monomer, is excellent in light transmitting characteristic, mechanical strength, precision in working, surface property, etc. and can be preferably used. Further, various kinds of other light transmitting materials such as acrylic resin, fluorine-contained resin, polyester resin, polycarbonate resin, and polyethylene-terephthalate resin can be used. Still further, it may be colored so long as it has a light transmitting property. For the light transmitting conductive layer, indium-tin oxide (ITO), tin oxide, lead oxide, indium oxide, copper iodide, and a metallic thin film keeping light transmitting capability composed of Au, Ag, Ni, Al, etc. can be used, and as regards the film forming method, a vacuum evaporation coating method, a reactive evaporation method, various kinds of sputtering methods, various kinds of CVD methods, a dip coating method, a spray coating method, etc. can be utilized. Further, for the photoconductive layer, various kinds of organic photoconductor (OPC) layer can be used.

The organic photosensitive layer as a photosensitive layer of a photoconductive layer is composed of two layers, which are a charge generating layer (CGL) composed mainly of a charge generating material (CGM) and a charge transporting layer (CTL) composed mainly of a charge transporting material, by the both of which the above-mentioned functions of the photoconductor are separately owned. An organic photosensitive layer of two-layer structure has a high durability as an organic photosensitive layer owing to its CTL being thick, and is suitable for the present invention. In addition, the organic photosensitive layer may be composed of a single layer including a charge generating material (CGM) and a charge transporting material (CTM) in it; in the photosensitive layer composed of said single layer or the above-mentioned two layers, usually binder resin is included.

A scorotron charging device 11 as a charging means, an exposure optical system 12*a* as an image writing means, and a developing device 13 as a developing means to be explained below are provided for an image forming process for each of colors yellow (Y), magenta (M), cyan (C), and black (K); in this embodiment, they are arranged in the order of Y, M, C, and K with respect to the rotating direction of the photoreceptor drum 10*a*.

The scorotron charging device 11 is mounted with its longitudinal direction made perpendicular (perpendicular to the plane of paper surface in FIG. 8) to the moving direction of the photoreceptor drum 10*a* facing, close to the photoreceptor drum 10*a*, and using a control grid (with no sign attached in the drawing) which is kept at a specified electric potential with respect to the above-mentioned conductive layer of the photoreceptor drum 10*a* and a discharging wire for example (with no sign attached in the drawing) as a corona discharging electrode, it practices charging action by corona discharging of the same polarity as the toners (negative charging in this example of practice), to give a uniform electric potential to the surface of the organic photosensitive layer. For the corona discharging electrode, also it is possible to use a sawtooth-shaped electrode or a needle-shaped electrode instead of the above-mentioned one.

The exposure optical system 12*a* has a structure as a unit for exposure comprising a linear-shaped exposure device (not shown in the drawing) composed of a plurality of LED's (light emitting diodes) as light emitting elements for image exposure arranged in an array parallel to the axis of the photoreceptor drum 10*a*, and a SELFOC lens (not shown in the drawing) as an image forming element of life sized magnification fitted to a holder. The exposure optical system 12*a* for each of colors is fitted and housed inside the base member of the photoreceptor drum 10*a*. For the exposure device, a linear-shaped one composed of a plurality of light emitting elements such as FL (electroluminescence) elements, PL (plasma discharging) elements arranged in an array instead of the above-mentioned LED elements can be used.

The exposure optical system 12*a* is disposed inside the photoreceptor drum 10*a* with its exposure position onto the photoreceptor drum 10*a* set at a position between the scorotron charging device 11 and the developing device 13 in the upstream side of the developing device 13 with respect to the rotating direction of the photoreceptor drum 10*a*.

The exposure optical system 12*a* applies image exposure to the uniformly charged photoreceptor drum 10*a* on the basis of the image data which have been transmitted from an external computer (not shown in the drawing), memorized in a memory, and subjected to an image processing, to form a latent image on the photoreceptor drum 10*a*. For the wavelength of the emitted light from the light emitting device used in this example of practice, one falling within a range of 680 to 900 nm, which is usually enough transmitted by the toners of Y, M, and C, is satisfactory; however, because image exposure is practiced from the rear side, a wavelength shorter than this, which is not sufficiently transmitted by the color toners, may be employed.

The developing device 13 contains inside a two-component developer comprising a flattened toner of yellow (Y), magenta (M), cyan (C), or black (K), and reversely develops a latent image on the photoreceptor drum 10*a* formed by the charging by means of the scorotron charging device 11 and the image exposure (image writing) by means of the exposure optical system 12*a*, in a non-contact state, with a toner of the same polarity as the polarity of the charge on the photoreceptor drum 10*a* (Because the photoreceptor is charged negatively in this example of practice, the toners have negative polarity.).

On the start of image formation, the photoreceptor drum 10*a* is rotated in the clockwise direction shown by the arrow mark in FIG. 8 by the starting of image forming member driving motor (not shown in the drawing), and at the same time, the giving of electric potential to the photoreceptor drum 10*a* is started by the charging action of the scorotron charging device 11 for Y. After the photoreceptor drum 10*a* has been given an electric potential, it is started in the exposure optical system for Y, the exposure (image writing) based on the electrical signal corresponding to the first color signal, that is, the image data of Y, and by the scanning rotation of the photoreceptor drum 10*a*, an electrostatic latent image corresponding to the image of yellow (Y) of the original image is formed on the photosensitive layer lying on the surface of the photoreceptor drum 10*a*. This latent image is reversely developed in a non-contact state by means of the developing device 13 for Y, and a toner image composed of yellow (Y) flattened toner particles is formed on the photoreceptor drum 10*a*.

Next, after the photoreceptor drum 10*a* is given an electric potential by the charging action of the scorotron device 11 for M on the above-mentioned yellow (Y) toner image, it is carried out in the exposure system 12*a* for M, exposure (image writing) based on the electrical signal corresponding to the second color signal, that is, the image data of magenta (M), and a toner image composed of magenta (M) flattened toner particles is formed superposed on the above-mentioned toner image composed of yellow (Y) flattened toner particles by non-contact reverse development by means of the developing device 13 for M.

By the similar process, by means of the scorotron charging device 11 for C, the exposure optical system 12*a* for C, and the developing device 13 for C, further a toner image composed of cyan (C) flattened toner particles corresponding to the third color signal, and by means of the scorotron charging device 11 for K, the exposure optical system 12*a* for K, and the developing device 13 for K, a toner image composed of black (K) flattened toner particles corresponding to the fourth color signal are formed sequentially superposed on the others; thus, within one rotation of the photoreceptor drum 10*a*, a color toner image with component color toner images composed of flattened toner particles superposed is formed on its circumferential surface.

In this way, in this example of practice, the exposure for the organic photosensitive layer of the photoreceptor drum 10*a* by means of each of the exposure optical systems 12*a* for Y, M, C, and K is carried out from the inside of the photoreceptor drum 10*a* through the light transmitting base member. Hence, it is possible that image exposure corresponding to each of the second, third, fourth color signals is not intercepted by the toner images which have been formed before, to form an electrostatic latent image, which is preferable; however, exposure may be carried out from the outside of the photoreceptor drum 10*a*.

On the other hand, a recording paper P, which is used as a transfer material (recording material), is conveyed out from a paper feed cassette 15 as a transfer material containing means by a conveying-out roller (with no sign attached in the drawing), is conveyed by conveyance rollers (with no sign attached in the drawing) to be fed to timing rollers 16.

The recording paper sheet P is synchronized with the color toner image having component color toner images composed of flattened toner particles superposed carried on the photoreceptor drum 10*a* by the driving of the timing rollers 16, and is fed to the transfer region (with no sign attached in the drawing) attracted to the conveyance belt 14A by the charging by means of the paper charging device 150 as a transfer material charging means. The recording paper sheet P, which has been conveyed by the conveyance belt 14A as sticking fast to it, accepts the component color toner images composed of flattened toner particles superposed which are transferred from on the photoreceptor drum 10*a* in the transfer region all at a time by means of a transfer device 14C as a transfer means, to which a voltage of the reverse polarity to the toners (positive polarity in this embodiment) is applied.

The recording paper sheet P, having superposed component color toner images composed of flattened toner particles transferred on it, is subjected to charge eliminating process by an AC charge eliminating device for paper separation 14*h* as a transfer material separating means, and is separated from the conveyance belt 14A, to be fed to a fixing device 17.

The fixing device 17 is composed of a fixing roller 17*a* as a fixing roller member (a roller member which is provided at the side to face a toner image on the transfer material) for fixing the superposed component color toner images composed of flattened toner particles, and a pressing roller 17*b* as a pressing roller member (a roller member which is provided at the side to face the transfer material surface having no toner image) provided opposite to the fixing roller 17*a*, and at the central part of the inside of the fixing roller, there is provided a halogen lamp HLa as a heating means having a heat generating filament (with no sign attached in the drawing) as a heat generating source.

The recording paper sheet P is gripped by the nip portion N which is formed between the fixing roller 17*a* and the pressing roller 17*b*, and by the application of heat and pressure, the superposed component color toner images composed of flattened toner particles are fixed; then, the recording paper sheet P is conveyed by discharging rollers 18, to be discharged onto a tray provided on the upper side of the apparatus.

Toner particles, which remain on the circumferential surface of the photoreceptor drum 10*a* after transfer processing, are removed by a photoreceptor cleaning blade (with no sign attached in the drawing) provided in the photoreceptor cleaning device 19 as an image forming member cleaning means. The photoreceptor drum 10*a*, which has been cleaned by removing the residual toner particles, is uniformly charged by the scorotron charging device 11, and enters the next cycle.

As described in the above, by using a flattened toner, as shown in FIG. 11(*a*), a color toner image composed of superposed component color toner images having no toner disturbance, which is made a thin layer and uniformly flattened, is formed on the photoreceptor drum 10*a*, and as shown in FIG. 11(*b*), also on a recording paper sheet P, to which the color toner image composed of superposed component color toner images on the photoreceptor drum 10*a* has been transferred, a color toner image composed of superposed component color toner images having no toner disturbance, which is made a thin layer and uniformly flattened, is formed.

Besides, in the above-mentioned image forming apparatus, explanation has been done with a color image forming process taken for instance; however, it is possible to practice an image forming process for a monochromatic image only.

Further, in the above-mentioned, it is preferable, for a flattened toner in monochromatic process to be deposited on the photoreceptor drum 10*a*, to make it the maximum necessary quantity, a quantity of such a degree that the flattened toner particles uniformly cover the latent image area of the photoreceptor drum 10*a* in a state that the flattened portions are laid laterally. That is, it is preferable that a preferable toner layer thickness of a flattened toner is (0.7–1.3)×d (d is the thickness of a flattened toner described before in FIG. 1) in a state where the flattened toner particles are deposited uniformly without clearance (a state where flattened toner particles are crushed), and by this layer thickness, a thin-layer toner image having enough image density can be formed.

In an image forming apparatus shown in FIG. 9, in the upper part of the image forming apparatus, there is a document placing section 111 composed of a document table made up of a transparent glass plate, document cover to cover a document D placed on the document table, etc., and under the document table inside the apparatus mainframe, there is provided an image reading section A composed of a first mirror unit 112, a second mirror unit 113, a main lens 120, a color CCD sensor 123, etc. The first mirror unit 112 is provided with an exposure lamp 114 and a first mirror 115, and is mounted in parallel with the document table movably straight in the horizontal direction in the drawing, to scan optically the whole surface of the document D. The second mirror unit 113 is provided with a second mirror 116 and a third mirror 117 formed as a unified body, and moves straight in the same horizontal direction as the first mirror unit at a speed of half the first mirror unit 112 so as to keep the optical path length at a specified value. Of course, the movement of this second mirror unit is parallel to the document table like the first mirror unit 112. The image of the document D on the document table illuminated by the exposure lamp 114 is formed on the color CCD sensor 123 through the first mirror 115, second mirror 116, and the third mirror 117 by the main lens 120. When scanning is finished, the first mirror unit 112 and the second mirror unit 113 come back to the initial position, to be ready for the next copy.

The image data for each of the colors obtained by the color CCD sensor 123 are subjected to image processing in an image processing section, to become an image signal for carrying out laser writing in an image forming section E to be explained next.

The image forming apparatus shown in FIG. 9 is a color image forming apparatus of a tandem type using an intermediate transfer member in the image forming section E. Its structure is as follows: Around the transfer belt 14*a* as an intermediate transfer member, there are provided four sets of process units 100 composed of black (K), cyan (C), magenta (M), and yellow (Y) units in the above-mentioned order from the upstream side in the rotating direction of the transfer belt 14*a*, and in each of the process units 100, a toner image of K, C, M, or Y using a flattened toner is formed; the toner images using such flattened toners are transferred onto the transfer belt 14*a* superposed on one another, and the transferred superposed color toner images are transferred onto a recording paper sheet P as a transfer material all at a time, to be fixed and discharged to the outside of the apparatus.

Because the four sets of the process units 100 have a common structure, one of them will be explained.

The photoreceptor drum 10 as an image forming member has a conductive layer and a photoconductive layer of an organic photosensitive layer (OPC) formed on the outer circumference of a cylindrical base member.

The photoreceptor drum 10 is rotated in the counter-clockwise direction shown by the arrow mark by a driving force from a driving source (not shown in the drawing) or in compliance with the motion of the transfer belt 14*a*, with the conductive layer grounded.

11 denotes a scorotron charging device as a charging means, and is mounted facing, close to the photoreceptor drum 10 with its lengthwise side directed towards the direction perpendicular to the moving direction of the photoreceptor drum 10, and gives the photoreceptor drum 10 a uniform electric potential by the corona discharging of the same polarity as the toners.

12 denotes an exposure optical system as an image writing means for carrying out image exposure for K, C, M, and Y on the basis of image data, and is a scanning optical system which carries out scanning parallel to the rotary axis of the photoreceptor drum 10 by means of a polygonal mirror, for example. A latent image is formed by carrying out image exposure on the uniformly charged photoreceptor drum 10 by the exposure optical system 12.

Close to the circumference of the photoreceptor drum 10, there is provided a developing device 13 containing a two-component developer composed of a negatively charged flattened toner and a magnetic carrier, to carry out development. In addition, as regards the development, both of contact development and non-contact development can be employed without problem. This toner image composed of flattened toner particles is transferred onto the transfer belt 14*a* to be explained later in the transfer site. The residual toner particles remaining on the photoreceptor drum 10 after transfer is finished are removed by a photoreceptor cleaning device 19 for carrying out an electrostatic method of collection.

The transfer belt 14*a*, which the four process units 100 for the respective colors K, C, M, and Y are arranged side by side facing, is an endless belt having a volume resistivity of $10^{10}$–$10^{15}$ Ω·cm and a sheet resistance of $10^{10}$–$10^{15}$ Ω/square; it is a seamless belt of two-layer structure composed of a semi-conductive film base member having a thickness of 0.1 to 1.0 mm formed of a conductive substance dispersed in an engineering plastic material such as modified polyimide, thermosetting polyimide, copolymer of ethylene and tetrafluoroethylene, polyvinylidene fluoride, or a nylon alloy and a toner filming preventing layer of fluorine-contained resin having a thickness of 5 to 50 μm coated on the outer surface of the above-mentioned semi-conductive film preferably. For the base member of the transfer belt 14*a*, instead of the above-mentioned, a semi-conductive rubber belt having a thickness of 0.5 to 2.0 mm, which is composed of silicone rubber, urethane rubber, or the like and a conductive material dispersed in it, can be also used. The transfer belt 14*a* is stretched around a driving roller 14*d*, a driven roller 14*e*, a tension roller 14*k*, and a backup roller 14*j*, and during image formation, the driving roller is rotated by the driving force of a drive motor (not shown in the drawing); at the transfer site for each of the colors, the transfer belt 14*a* is pressed to the photoreceptor drum 10 by a primary transfer roller 14*c* as a primary transfer means, and the transfer belt 14*a* is rotated in the direction shown by the arrow mark in the drawing.

The primary transfer roller 14*c* made up of a roller member as a primary transfer means for each color is provided opposite to the photoreceptor drum 10 with the transfer belt 14*a* held in between, to form a transfer region (with no sign attached in the drawing) for each color between the transfer belt 14*a* and the photoreceptor drum 10 for each color. By applying a direct current voltage of the reverse polarity to the toners (positive polarity in this example of practice) to the primary transfer roller 14*c* for each color, to form a transfer electric field in the transfer region, the toner image on the photoreceptor drum 10 for each color is transferred onto the transfer belt 14*a*.

A charge eliminating device 14*m* as a charge eliminating means for each color is preferably made up of a corona discharging device, and eliminates the charge on the transfer belt 14*a* having been charged by the primary transfer roller 14*c*.

On the start of the image recording, the photoreceptor drum 10 of the process unit 100 for black (K) is rotated in the direction shown by the arrow mark in the drawing by the starting of a photoreceptor drum driving motor (not shown in the drawing), and at the same time, by the charging action of the scorotron charging device 11 for K, the giving of charge to the photoreceptor drum 10 for K is started.

After the photoreceptor drum 10 for K is given an electric potential, image writing based on the electrical signal outputted from the control section is started by the exposure optical system 12 for K, and an electrostatic latent image corresponding to the outputted image signal from the control section is formed on the surface of the photoreceptor drum 10 for K.

The above-mentioned latent image of K is developed reversely in a non-contact state by the developing device 13 for K, and a toner image composed of flattened toner particles of K is formed in response to the rotation of the photoreceptor drum 10 for K.

The toner image composed of flattened toner particles of K formed on the photoreceptor drum 10 for K as an image forming member by the above-mentioned image forming process is transferred onto the transfer belt 14*a* in the transfer region for K (with no sign attached in the drawing) by the primary transfer roller 14*c* for K.

A little later than the starting of the process unit 100 for K, the photoreceptor drum 10 of the process unit 100 for cyan (C) is rotated in the direction shown by the arrow mark in the drawing, and at the same time, the giving of an electric potential to the photoreceptor drum 10 for C is started by the charging action of the scorotron charging device 11 for C.

After the photoreceptor drum 10 for C is given an electric potential, image writing based on the electrical signal corresponding to the image data of C is started in synchronism with the toner image of K by the exposure optical system 12 for C, and an electrostatic latent image corresponding to the image of C of the original image is formed on the surface of the photoreceptor drum 10 for C.

The above-mentioned latent image of C is reversely developed in a non-contact state by the developing device 13 for C, and in response to the rotation of the photoreceptor drum 10 for C, a toner image of C composed of the flattened toner particles of C is formed.

The toner image composed of the flattened toner particles of C, which has been formed on the photoreceptor drum 10 for C as an image forming member by the above-mentioned image forming process, is transferred onto the toner image composed of the flattened toner particles of K on the transfer belt 14*a* in the transfer region for C (with no sign attached in the drawing) by the primary transfer roller 14*c* for C.

Next, on the transfer belt 14*a*, the toner image composed of the flattened toner particles of M corresponding to the image data of M, which has been formed on the photoreceptor drum 10 for M in synchronism with the superposed toner images of K and C by the process unit 100 for magenta (M), is transferred onto the superposed toner images respectively composed of the flattened toner particles of K and C in the transfer region for M (with no sign attached in the drawing) by the primary transfer roller 14*c* for M, to form superposed toner images.

In the same way, the toner image of Y composed of the flattened toner particles of Y corresponding to the image data of Y, which has been formed on the photoreceptor drum 10 for Y in synchronism with the superposed toner images of K, C, and M by the process unit 100 for yellow (Y), is transferred onto the above-mentioned superposed toner images respectively composed of the flattened toner particles of K, C, and M in the transfer region for Y (with no sign attached in the drawing) by the primary transfer roller 14*c* for Y, to form superposed toner images; thus, superposed color toner images composed of the flattened toner particles of K, C, M, and Y respectively are formed on the transfer belt 14*a*.

The residual toner particles remaining on the circumferential surface of the photoreceptor drum 10 for each color after transfer are removed by the photoreceptor cleaning device 19 as an image forming member cleaning means for each color.

In synchronism with the formation of the superposed color toner images on the transfer belt 14*a*, a recording paper sheet P, which is used as a transfer material (recording material), is conveyed from a paper feed cassette 15, through a timing roller 16 as a transfer material feeding means, to the transfer region (with no sign attached in the drawing) of a secondary transfer device 14*g* as a second transfer means; then, by the secondary transfer device 14*g* to which a direct current voltage of the reverse polarity to the toners is applied, the superposed color toner images composed of the flattened toner particles on the transfer belt 14*a* are transferred onto the recording paper sheet P all at a time. Thus, superposed color toner images respectively composed of the flattened toner particles of K, C, M, and Y come to be present on the recording paper sheet P.

As regards the recording paper sheet P, to which superposed color toner images have been transferred, its charge is eliminated by a charge eliminating electrode 16*b* made up of a sawtooth-shaped electrode plate as a separation means, and it is conveyed to a fixing device 17.

The fixing device 17 is composed of a fixing roller 17*a* as a fixing roller member (a roller member which is provided at the side to face a toner image on the transfer material) for fixing superposed color toner images composed of flattened toner particles, and a pressing roller 17*b* as a pressing roller member (a roller member which is provided at the side to face the surface of the transfer material having no toner image) provided opposite to the fixing roller 17*a*. At the central part of the inside of the fixing roller 17*a*, there is provided a halogen lamp HLa as a heating means having a heat generating filament (with no sign attached in the drawing) as a heat generating source.

The superposed color toner images composed of the flattened toner particles are fixed between the fixing roller 17*a* and the pressing roller 17*b* by applying heat and pressure; then, the recording paper sheet P is conveyed by discharging rollers 18, to be discharged onto a tray provided on the upper side of the apparatus.

Residual toner particles, which remain on the circumferential surface of the transfer belt 14*a* after transfer processing, are removed by an intermediate transfer member cleaning device 19*a* as an intermediate transfer member cleaning means provided opposite to the driven roller 14*e* with the transfer belt 14*a* held in between.

As described in the above, by using a flattened toner, as shown in FIG. 11(*a*), a toner image having no toner disturbance, which is made a thin layer and uniformly flattened, is formed on the photoreceptor drum 10, and as shown in FIG. 11(*c*), also on the transfer belt 14*a*, to which toner images on the respective photoreceptor drums 10 for the respective colors are transferred, a color toner image having no toner disturbance composed of component color toner images superposed, which is made a thin layer and uniformly flattened, is formed; further, as shown in FIG. 11(*b*), also on a recording paper P, to which the color toner image composed of the component color toner images superposed on the transfer belt 14*a* have been transferred, a color toner image composed of component color toner images superposed having no toner disturbance, which is made a thin layer and uniformly flattened, is formed.

Further, in the above-mentioned, it is preferable that, for a flattened toner in monochromatic process to be deposited on the photoreceptor drum 10, it is preferable to make it the maximum necessary quantity, a quantity of such a degree that the flattened toner particles uniformly cover the latent image area of the photoreceptor drum 10 in a state that the flattened portions are laid laterally. That is, it is preferable that a preferable toner layer thickness composed of flattened toner particles is (0.7–1.3)×d (d is the thickness of a flattened toner described before in FIG. 1) in a state where the flattened toner particles are deposited uniformly without clearance (a state where flattened toner particles are crushed), and by this layer thickness, a thin-layer toner image having enough image density can be formed.

The color image forming apparatus shown in FIG. 10 is a color image forming apparatus of a tandem type using an intermediate transfer member. Its structure is as follows: Around the circumference of the transfer belt 14*a* as an intermediate transfer member, there are provided four sets of process units 100 for forming a color image consisting of a black (K) unit, a cyan (C) unit, a magenta (M) unit, and a yellow (Y) unit in this order from the upstream side in the rotating direction of the transfer belt 14*a*, and in each of the process units 100 for K, C, M, and Y, a toner image consisting of superposed toner images using a low-density toner composed of flattened particles and a high-density toner composed of flattened particles, composed of flattened toner particles of K, C, M, or Y is formed; the toner images composed of the flattened toner particles of the respective colors formed in the respective process units 100 are transferred onto the transfer belt 14*a* superposed on one another, to form a color toner image consisting of the superposed component color toner images composed of the respective flattened color toner particles on the transfer belt 14*a*, and the superposed component color toner images composed of the respective flattened toner particles, which have been transferred onto the transfer belt 14*a*, are transferred onto a transfer material all at a time, to be fixed and discharged to the outside of the apparatus.

Because the four sets of process units 100 for K, C, M, and Y have a common structure, one of them will be explained.

The process unit 100 is composed of a photoreceptor drum 10, and from the upstream side as seen from the transfer site for a toner image with respect to the rotating direction of the photoreceptor drum 10, a photoreceptor cleaning device 19 for removing toner particles remaining after transfer on the photoreceptor drum 10, a scorotron charging device for low-density toner 11(L) for forming a low-density toner image, an exposure optical system for low-density toner 12(L), a developing device for a low-density toner composed of flattened toner particles 13(L), a scorotron charging device for high-density toner 11(H) for forming a high-density toner image, an exposure optical system for high-density toner 12(H), and a developing device for a high-density toner composed of flattened toner particles 13(H).

The photoreceptor drum 10 as an image forming member is composed of a conductive layer and a photoconductive layer of an organic photosensitive layer (OPC) formed on the outer circumference of a cylindrical base member made up of, for example, an aluminum pipe, an acrylic resin pipe, etc.

The photoreceptor drum 10 is rotated in the counterclockwise direction shown by the arrow mark in the drawing by the driving force of a drive source (not shown in the drawing) or in compliance with the motion of the transfer belt 14*a*, with the conductive layer grounded.

Each of the scorotron charging device 11(L) as a charging means for low-density toner (a first charging means) and the scorotron charging device 11(H) as a charging means for high-density toner (a second charging means) is mounted facing, close to the photoreceptor drum 10, with its lengthwise side directed towards the direction perpendicular to the moving direction of the photoreceptor drum 10, and gives the photoreceptor drum 10 a uniform electric potential by the corona discharging of the same polarity as the toners.

For each of the exposure optical system 12(L) as an image exposure means for low-density toner (a first exposure means) and the exposure optical system 12(H) as an image exposure means for high-density toner (a second exposure means), a scanning optical system which makes scanning parallel to the rotary axis of the photoreceptor drum 10 by a polygonal mirror, for example, is used. The exposure optical system 12(L) is an image writing means employing an external exposure method for practicing a first image writing (first image exposure) based on the image data for a low-density toner, and the exposure optical system 12(H) is an image writing means employing an external exposure method for practicing a second image writing (second image exposure) based on the image data for a high-density toner.

The developing device 13(L) as a developing means for a low-density toner composed of flattened toner particles (first developing means) stores inside a developer including a low-density toner composed of flattened toner particles, and practices a first reverse development in a contact or non-contact method. Further, the developing device 13(H) as a developing means for a high-density toner composed of flattened toner particles (second developing means) stares inside a developer including a high-density toner composed of flattened toner particles, and practices a second reverse development in a non-contact method.

In forming an image, image data for each of the colors are separated into image data for the low-density toner and image data for the high-density toner. First, the first image exposure based on the image data for the low-density toner is carried out by the exposure optical system 12(L) for the photoreceptor drum 10 which has been charged uniformly by the scorotron charging device for low-density toner 12(L), to form a latent image for the low-density toner, and the first development with the low-density toner composed of flattened toner particles is carried out by a developing roller 13*a*(L) of the developing device 13L for a low-density toner composed of flattened toner particles. Next, the photoreceptor drum, which has a low-density toner image composed of flattened toner particles formed on it, is charged again by the scorotron charging device for high-density toner 12(H), and the second image exposure based on the image data for the high-density toner is carried out by the exposure optical system 12(H), to form a latent image for the high-density toner; then, the second development with the high-density toner composed of flattened toner particles is carried out by a developing roller 13*a*(H) of the developing device 13H for a high-density toner composed of flattened toner particles, to form a toner image with the high-density toner composed of flattened toner particles, superposed on the toner image made up of the low-density toner composed of flattened toner particles on the photoreceptor drum 10. These toner images made up of the high-density and low-density toners composed of flattened toner particles (superposed toner images) are transferred onto the transfer belt 14*a* at the transfer site of the first transfer means.

Residual toner particles remaining after the transfer process on the photoreceptor drum 10 from which the toner image has already been transferred are removed by the photoreceptor cleaning device 19 for practicing electrostatic collection of residual toner particles.

The transfer belt 14*a*, which the four process units 100 for the respective colors K, C, M, and Y are arranged side by side facing, is an endless belt having a volume resistivity of $10^{10}$–$10^{15}$ Ω·cm and a sheet resistance of $10^{10}$–$10^{15}$ Ω/square; it is a seamless belt of two-layer structure composed of a semi-conductive film base member having a thickness of 0.1 to 1.0 mm formed of a conductive substance dispersed in an engineering plastic material such as modified polyimide, thermosetting polyimide, copolymer of ethylene and tetrafluoroethylene, polyvinylidene fluoride, or a nylon alloy and a toner filming preventing layer of fluorine-contained resin having a thickness of 5 to 50 μm coated on the outer surface of the above-mentioned semi-conductive film preferably. For the base member of the transfer belt 14*a*, instead of the above-mentioned, a semi-conductive rubber belt having a thickness of 0.5 to 2.0 mm, which is composed of silicone rubber, urethane rubber, or the like and a conductive material dispersed in it, can be also used. The transfer belt 14*a* is stretched around a driving roller 14*d*, a driven roller 14*e*, a tension roller 14*k*, and a backup roller 14*j*, and during image formation, the driving roller 14*d* is rotated by the driving force of a drive motor (not shown in the drawing); at the transfer site for each of the colors, the transfer belt 14*a* is pressed to the photoreceptor drum 10 by a primary transfer roller 14*c*, and the transfer belt 14*a* is rotated in the direction shown by the arrow mark in the drawing.

The primary transfer roller 14*c* made up of a roller member as a primary transfer means for each of colors K, C, M, and Y is provided opposite to each of the photoreceptor drums 10 with the transfer belt 14*a* held in between, to form a transfer region (with no sign attached in the drawing) for each color between the transfer belt 14*a* and the photoreceptor drum 10 for each color. By applying a direct current voltage of the reverse polarity to the toners (positive polarity in this example of practice) to the primary transfer roller 14*c* for each color, to form a transfer electric field in the transfer region, the toner images made up of the high-density toner and the low-density toner composed of flattened toner particles on the photoreceptor drum 10 for each of colors K, C, M, and Y is transferred onto the transfer belt 14*a*.

A charge eliminating device 14*n* as a charge eliminating means for each color is preferably made up of a corona discharging device, and eliminates the charge on the transfer belt 14*a* having been charged by the primary transfer roller 14*c*.

On the start of the image recording, the photoreceptor drum 10 of the process unit 100 for black (K) is rotated in the direction shown by the arrow mark in the drawing by the starting of a photoreceptor driving motor (not shown in the drawing), and at the same time, by the charging action of the scorotron charging device 11(L) for low-density toner for K, the giving of charge to the photoreceptor drum 10 for K is started.

After the photoreceptor drum 10 for K is given an electric potential, it is started the first image exposure employing an external exposure method based on the electrical signal corresponding to the image data for the low-density toner for K of the first color signal is started by the exposure optical system 12(L) for low-density toner for K, and an electrostatic latent image for the low-density toner corresponding to the image of K of the original image is formed on the surface of the photoreceptor drum 10 for K.

The above-mentioned latent image for the low-density toner is subjected to the first reverse development in a contact state by the developing device 13(L) for a low-density toner composed of flattened toner particles for K, and a toner image made up of the low-density toner composed of flattened toner particles of K is formed in response to the rotation of the photoreceptor drum 10 for K. Subsequently, through the formation of an electrostatic latent image for the high-density toner corresponding to the image for K by the charging by means of the scorotron charging device for high density toner 11(H) for K, and the second image exposure employing an external exposure method by means of the exposure optical system for high-density toner 12(H) for K based on the electrical signal corresponding to the image data for the high-density toner for K of the first color signal, and the second development by means of the developing device 13(H) for the high-density toner composed of flattened toner particles of K, a toner image made up of the high-density toner composed of flattened toner particles of K is formed superposed on the toner image made up of the low-density toner composed of flattened toner particles of K having been formed before.

The toner image of K made up of the high-density toner and the low-density toner both composed of flattened toner particles formed on the photoreceptor drum 10 for K as an image forming member by the above-mentioned image forming process (the toner image consisting of superposed toner images composed of flattened toner particles) is transferred onto the transfer belt 14*a* in the transfer region for K (with no sign attached in the drawing) by the primary transfer roller 14*c* for K.

Next, on the transfer belt 14*a*, the toner image of C made up of the high-density toner and the low-density toner both composed of the flattened toner particles of C corresponding to the image data for the high-density toner and the low-density toner of C based on the second color signal, which has been formed on the photoreceptor drum 10 for C in synchronism with the toner image of K by the process unit 100 for cyan (C) (the toner image of C consisting of the two kinds of toner layers superposed), is transferred onto the toner image of K made up of the high-density toner and the low-density toner composed of the flattened toner particles of K on the above-mentioned transfer belt 14*a* in the transfer region for C (with no sign attached in the drawing) by the primary transfer roller 14*c* for C, to form superposed toner images.

In the same way, the toner image of M made up of the high-density toner and the low-density toner both composed of the flattened toner particles of M corresponding to the image data for the high-density toner and the low-density toner of M based on the third color signal, which has been formed on the photoreceptor drum 10 for M in synchronism with the superposed toner images of K and C, by the process unit 100 for magenta (M) (the toner image of M composed of the two kinds of toner layers superposed), is transferred onto the superposed toner images of K and C composed of the flattened toner particles of K and C respectively on the above-mentioned transfer belt 14*a* in the transfer region for C (with no sign attached in the drawing) by the primary transfer roller 14*c* for M, to form superposed toner images on the transfer belt 14*a*. Further, the toner image of Y made up of the high-density toner and the low-density toner both composed of the flattened toner particles of Y corresponding to the image data for the high-density toner and the low-density toner of Y based on the fourth color signal, which has been formed on the photoreceptor drum 10 for Y in synchronism with the superposed toner images of K, C, and M by the process unit 100 for yellow (Y) (the toner image of Y consisting of the two kinds of toner layers superposed), is transferred onto the superposed toner images of K, C, and M composed of the flattened toner particles of K, C, and M respectively on the above-mentioned transfer belt 14*a* in the transfer region for Y (with no sign attached in the drawing) by the primary transfer roller 14*c* for Y, to form a color toner image made up of the superposed component color toner images of K, C, M, and Y composed of flattened toner particles on the transfer belt 14*a*.

The residual toner particles remaining on the circumferential surface of the photoreceptor drum 10 for each color after transfer are removed by the photoreceptor cleaning device 19 as an image forming member cleaning means for each color.

In synchronism with the formation of the color toner image consisting of the superposed component color toner images on the transfer belt 14*a*, a recording paper sheet P, which is mainly used as a transfer material (recording material), is conveyed from a paper feed cassette 15 as a transfer material containing means, through a timing roller 16 as a transfer material feeding means, to the transfer region (with no sign attached in the drawing) of a secondary transfer device 14*g* as a second transfer means; then, by the secondary transfer device 14*g* to which a direct current voltage of the reverse polarity to the toners is applied, the superposed color toner images composed of the flattened toner particles on the transfer belt 14*a* are transferred onto the recording paper sheet P all at a time.

As regards the recording paper sheet P to which the color toner image consisting of the superposed component color toner images composed of flattened toner particles has been transferred, its charge is eliminated by a charge eliminating electrode 16*b* made up of a sawtooth-shaped electrode plate as a separation means, and it is conveyed to a fixing device 17.

The fixing device 17 is composed of a fixing roller 17*a* as a fixing roller member (a roller member which is provided at the side to face a toner image on the transfer material) for fixing superposed color toner images composed of flattened toner particles, and a pressing roller 17*b* as a pressing roller member (a roller member which is provided at the side to face the surface of the transfer material having no toner image) provided opposite to the fixing roller 17*a*. At the central part of the inside of the fixing roller, there is provided a halogen lamp HLa as a heating means having a heat generating filament (with no sign attached in the drawing) as a heat generating source.

The superposed color toner images composed of the flattened toner particles on the recording paper sheet P are fixed between the fixing roller 17*a* and the pressing roller 17*b* by applying heat and pressure; then, the recording paper sheet P is conveyed by discharging rollers 18, to be discharged onto a tray provided on the upper side of the apparatus.

Residual toner particles, which remain on the circumferential surface of the transfer belt 14*a* after transfer processing, are removed by an intermediate transfer member cleaning device 19*a* as an intermediate transfer member cleaning means provided opposite to the driven roller 14*e* with the transfer belt 14*a* held in between.

As described in the above, by using a flattened toner, as shown in FIG. 11(*a*), a toner image having no toner disturbance, which is made a thin layer and uniformly flattened, is formed on the photoreceptor drum 10, and as shown in FIG. 11(*c*), also on the transfer belt 14*a*, to which toner images on the respective photoreceptor drums 10 for the respective colors have been transferred, a color toner image having no toner disturbance consisting of superposed component color toner images, which is made a thin layer and uniformly flattened, is formed; further, as shown in FIG. 11(*b*), also on a recording paper P, to which the color toner image consisting of the superposed component color toner images on the transfer belt 14*a* has been transferred, a color toner image having no toner disturbance consisting of superposed component color toner images, which is made a thin layer and uniformly flattened, is formed.

Further, in the above-mentioned, for a flattened toner in monochromatic process to be deposited on the photoreceptor drum 10, it is preferable to make it the maximum necessary quantity, a quantity of such a degree that the flattened toner particles uniformly cover the latent image area of the photoreceptor drum 10 in a state that the flattened portions are laid laterally. That is, it is preferable that a preferable toner layer thickness of a flattened toner is (0.7–1.3)×d (d is the thickness of a flattened toner described before in FIG. 1) in a state where the flattened toner particles are deposited uniformly without clearance (a state where flattened toner particles are crushed), and by this layer thickness, a thin-layer toner image having enough image density can be formed.

Any one of the structures of the present invention is an image forming method which uses a flattened toner for a toner in a two-component developer and has the excellent effect that a high-density image can be obtained with a small amount of toner consumption and a high-quality image with little ruggedness and no toner scattering can be obtained; the effect that an excellent image is formed by using a flattened toner is actualized by the following:

(1) regulating the posture of flattened toner particles in adhering;

(2) using an external additive having a proper charging property;

(3) using an external additive of a proper size in a proper state of adhesion;

(4) practicing a proper treatment in preparing a flattened toner; and (5) controlling the distribution in the shape factors of a flattened toner properly.

Figure 12:
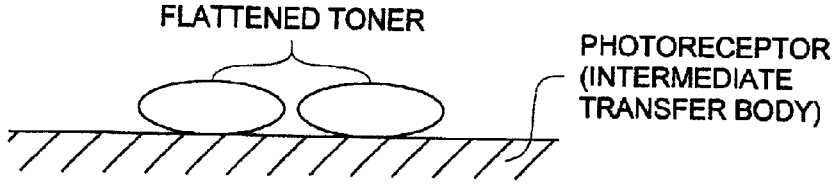
FIG. 12(*a*) to FIG. 12(*d*) are drawings showing states of particles of a flattened toner attaching, in a single-component developing method.
Figure 12:
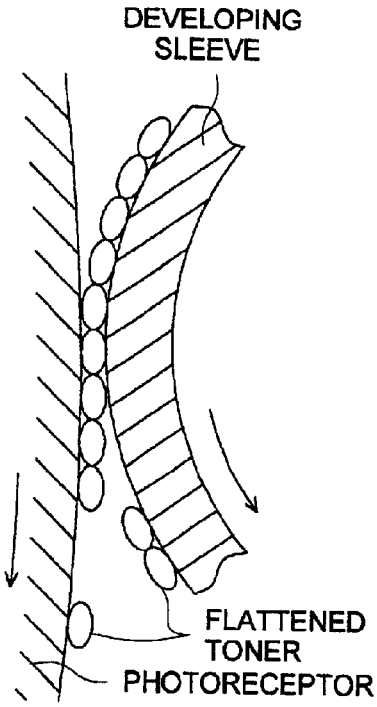
Figure 12:
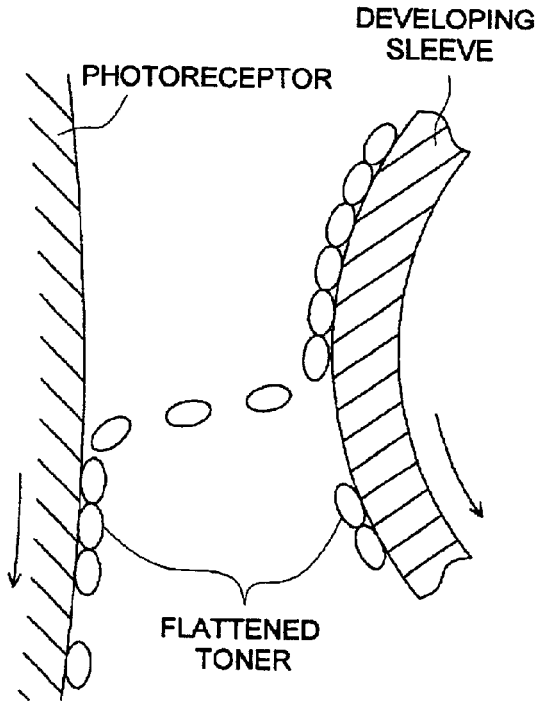
Figure 12:
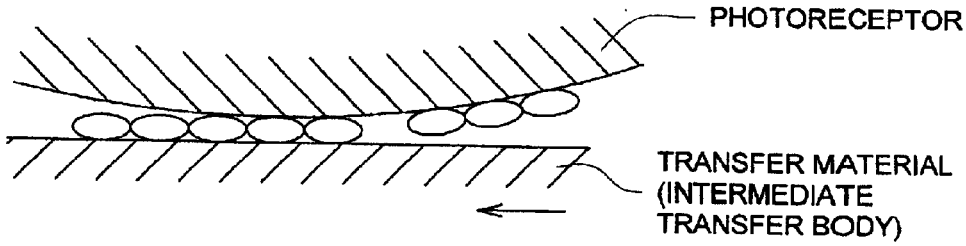

(11) In a single-component developing method, a flattened toner particle explained in the above is charged by frictional charging to be explained later, to have its flattened portions charged; therefore, as shown in FIG. 12(*a*), flattened toner particles are arrayed in the lateral direction with their end portions laid down by Coulomb's force and the flattened portions kept in contact with the surface of the toner supporting member such as an image forming member or an intermediate transfer member. Because the repulsive force in the lateral direction between the toner particles is weak, the state of adhesion is stable even in an array of the particles on the toner supporting member.

Because flattened toner particles have a strong repulsive force in the vertical direction in the state of its adhering to an image forming member, toner particles are difficult to superpose one another in development, and a thin toner layer is formed. As regards a toner image formed by development, toner scattering and spreading of the toner image do not occur. FIG. 12(*b*) shows the posture of flattened toner particles in the case of a contact development in a single-component developing method; flattened toner particles which have moved to the developing region with their flattened portion kept in contact with the developing sleeve move onto the latent image area with the flattened posture kept as it is in such a way that the flattened portion is rubbed against the photoreceptor (image forming member). The shifting of flattened toner particles (developing) is carried out under an electric field produced by an applied DC bias voltage; in a contact development using a flattened toner, superposed application of an AC bias voltage is especially effective because it assists development.

FIG. 12(*c*) shows the posture of flattened toner particles in the case of a non-contact development in a single-component development method; under a bias voltage composed of a DC voltage with an AC component superposed, flattened toner particles which have moved to the developing region with their flattened portion kept in contact with the developing sleeve are detached from the developing sleeve by the applied developing bias voltage, to fly towards the latent image area of the photoreceptor. During the flight, the flattened toner particles takes the posture of lengthwise direction owing to air resistance, and when it adheres to the photoreceptor, it vibrates under the AC bias voltage to come to keep the stabilized flattened posture in which the flattened portion is kept in contact with the photoreceptor; thus, development is carried out.

FIG. 12(*d*) shows the posture of flattened toner particles during transfer process; because a toner image (layer) formed on the photoreceptor is flat and the repulsive force in the lateral direction of the adhering toner particles is weak, transfer is carried out in a high fidelity with the flattened posture kept as it is. In addition, because toner particles attached on the photoreceptor have their flattened portion kept in contact with the photoreceptor, the electrical attracting force is large and the thickness of the toner layer is small; therefore, transfer before the transfer region is hard to occur, and because transfer is done only in the transfer region, toner disturbance does not occur too.

(12) In the case where development is done using a single-component developer of a flattened toner, in both of non-contact development and contact development, an excellent developing performance is exhibited as compared to cases where a spherical toner is used.

Figure 14:
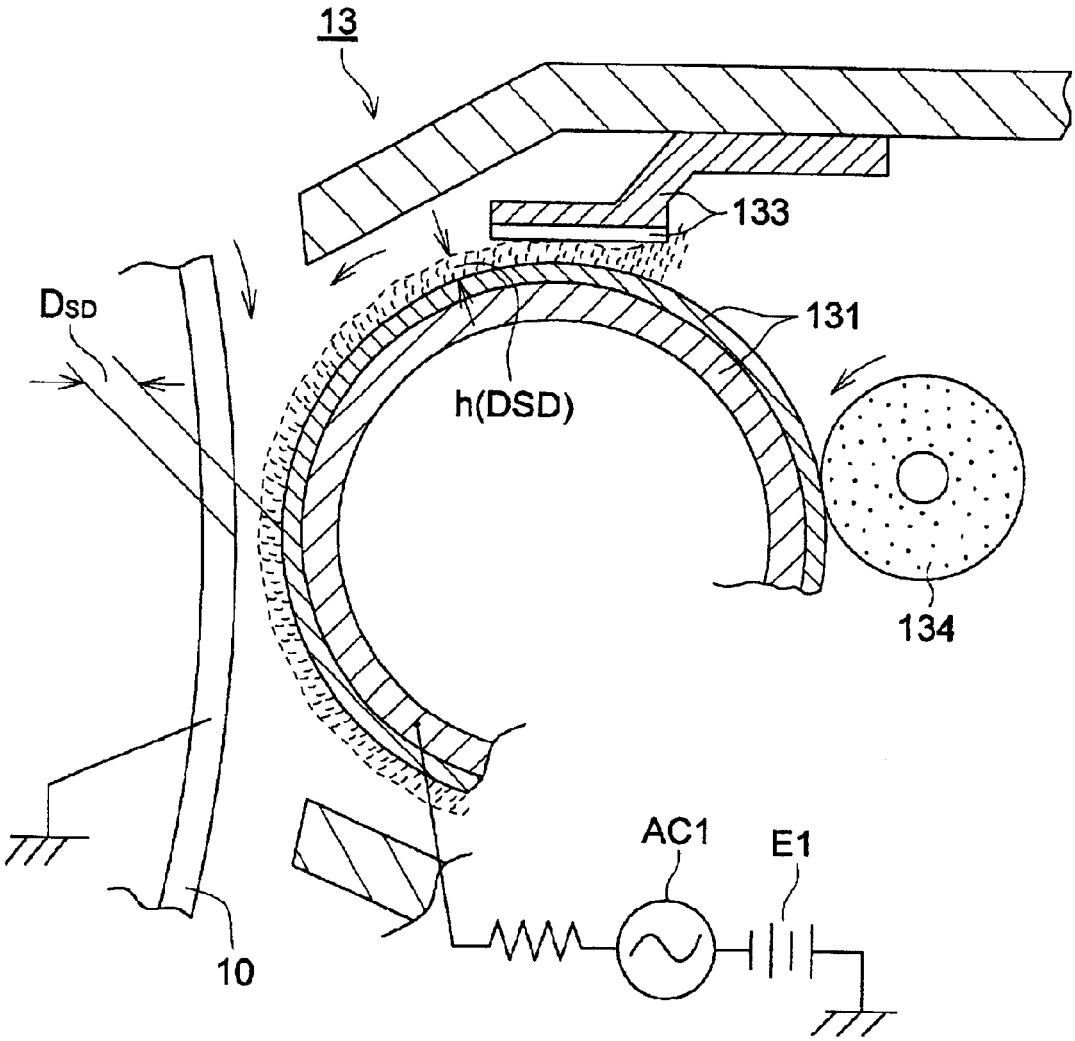
FIG. 14 is a cross-sectional view of the structure of a developing sleeve facing a photoreceptor drum, in a single-component developing method.

FIG. 14 shows the cross-sectional structure of a developing device 13 which is positioned opposite to a photoreceptor drum 10.

A developing sleeve 131 as a developer carrying member is made up of a non-magnetic cylindrical member having an outer diameter of 30 mm to 80 mm made of, for example, a stainless steel material, and is rotated in the direction with the moving direction of the photoreceptor drum 10 kept at a specified gap $D_{SD}$ to it by a rolling spacer (not shown in the drawing) provided at the both ends of the developing sleeve 131. It is of no problem to employ a structure such that the sleeve rotates in the direction against moving direction of the photoreceptor drum. The reference numeral 134 denotes a sponge roller for carrying out the preliminary charging of toner particles in the toner container.

On the circumferential surface of the developing sleeve 131, it is practiced to coat styrene resin, vinyl resin, ethylene resin, rosin-modified resin, acrylic resin, polyamide resin, epoxy resin, polyester resin, silicone resin, or fluorine-contained resin. Further, the circumferential surface of the developing sleeve 131 is made to have a surface roughness of 1 to 15 $\mu$m, as a processing for making the surface capable of making friction against a single-component developer actively and improving the conveying capability.

The reference numeral 133 denotes a layer thickness regulating member which is a pressing member; on its surface facing the developing sleeve 131, there is provided a blade made of a rubber material or the like. Flattened toner particles, which have been charged preliminarily by the friction against the developing sleeve and the sponge roller while passing between them, to come to adhere to the developing sleeve 131, are pressed by the layer thickness regulating member 133, and are frictionally charged by the rotating developing sleeve 131. Thus, the flattened toner particles are carried to the developing region with their flattened portion kept in contact with the developing sleeve 131. When a flattened toner is used, the layer thickness h ($D_{SD}$) is made 1 to 1.5 layers to form a thin toner layer, and the surface coverage ratio of the toner particles to the surface area of the developing sleeve 131 falls within a range of 60 to 120%, and development is carried out in this condition.

With the flattened toner particles, which have been carried to the developing region, where the developing sleeve faces the photoreceptor drum 10 keeping the developing gap at $D_{SD}$, with their layer thickness regulated to be 1 to 1.5 layers by the layer thickness regulating member 133 in such a way as to make the flattened portions adhere to the sleeve surface, reverse development is done for an electrostatic latent image on the photoreceptor drum 10 in a contact or non-contact state by a contact or non-contact developing method, under a development bias voltage composed of a direct current (DC) bias voltage E1 with an alternate current (AC) bias voltage AC1 superposed applied to the developing sleeve 131.

(Non-contact Development)

In non-contact development, it is preferable that the gap $D_{SD}$ between the developing sleeve 131 and the photoreceptor drum 10 is set at a value falling within a range of 200 to 800 μm. If this gap is smaller than 200 μm, uniform development gap is hard to keep, and stable development cannot be done. On the contrary, if the gap exceeds 800 μm, the so-called opposite electrode effect is lowered and enough developing density cannot be obtained. Further, at the gap $D_{SD}$ falling within the range 200 to 800 μm, it is put into practice that the developing gap and the thickness of the developer layer are set at values satisfying a condition that the developer layer is kept out of contact with the surface of the photoreceptor drum 10 and is as close as possible to it, in a state of oscillating electric field being not generated during no image formation. By doing it, it is prevented that grain in a toner image owing to the brushing appears or that the background density is produced. It is preferable that the position of the developing sleeve 131 facing, close to the photoreceptor drum 10 is such that the direction of gravity is directed towards the developing sleeve 131, for the reason of preventing the scattering of toner particles etc., but of course, it is not limited to this. Further, for the developing sleeve, the outer diameter of 20 to 100 mm, and preferably 30 to 80 mm, is used, and it is preferable that the speed and the direction of the rotation of the developing sleeve 131 is slow and against the moving direction of the photoreceptor drum 10, from the view point of preventing the scattering of toner particles etc; however, from the view point of image reproducibility of the developing layer, it is preferable that the rotating direction is with the moving direction of the photoreceptor drum 10, and the circumferential speed of the developing sleeve 131 is suppressed within 1.5 to 3.5 times the circumferential speed of the photoreceptor drum 10. However, it is not limited to this.

As regards the development under an oscillating electric field, it is preferable that the development is carried out by applying a voltage composed of a direct-current voltage relating to the prevention of background density and to the developing density and an alternate-current voltage superposed relating to the developing density and to the gradation characteristic, and generating an oscillating electric field in the development region by the voltage. For the direct current component of the bias voltage, in reverse development, it is set at a value smaller than the accepted charge potential in the background area having no image of the photoreceptor drum 10 by about 100 to 200 V. For the alternate current component, a voltage falling within a range of the frequency 1 to 10 kHz and the amplitude $V_{PP}$ 1,500 to 3,000 V is used. The above-mentioned alternate current component of the bias voltage is not limited to a sinusoidal wave, but may be a rectangular wave, a triangular wave, or the like. If the frequency of the alternate current component is too low, the pitch of oscillation appears in the developed image, and if it is too high on the contrary, it appears the tendency that the developer particles cannot comply with the oscillation of the electric field, which lowers the developing density and makes it impossible to reproduce a sharp high-quality image. Concerning the amplitude of the alternate current component $V_{PP}$, although it relates to the frequency too, the larger it is, the more the developer layer oscillates, and more toner particles are released from the constraint by the electrostatic force to the developing sleeve 131 to fly for development and the effect of the electric bias is increased with it; however, on the other hand, the larger it is, the more the background density tends to be produced and the easier the dielectric breakdown such as a phenomenon of the falling of a thunderbolt is to occur. However, because the circumferential surface of the developing sleeve 131 is insulated with resin etc., insulating flattened toner particles are prevented from being subjected to continuous dielectric breakdown, and also the generation of the background density can be prevented by the direct current component of the bias voltage.

Figure 13:
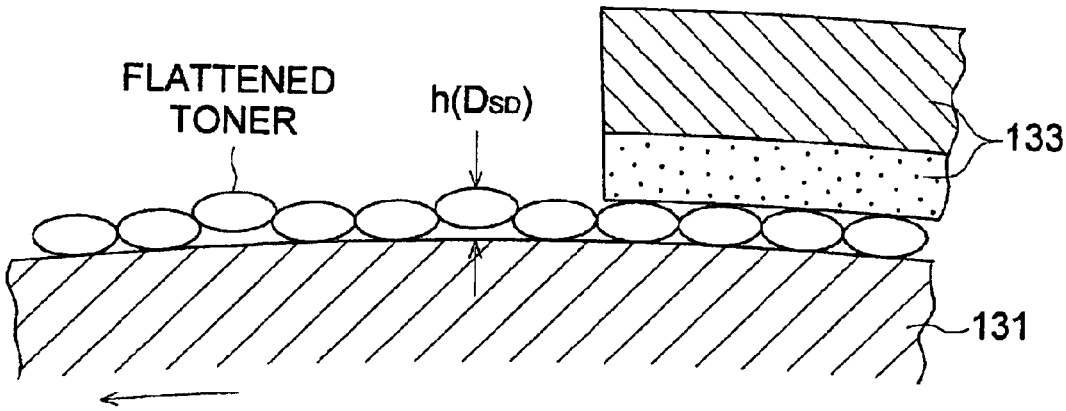
FIG. 13(*a*) and FIG. 13(*b*) are projection drawings showing states of particles of a flattened toner attaching to a developing sleeve, in a single-component developing method.
Figure 13:
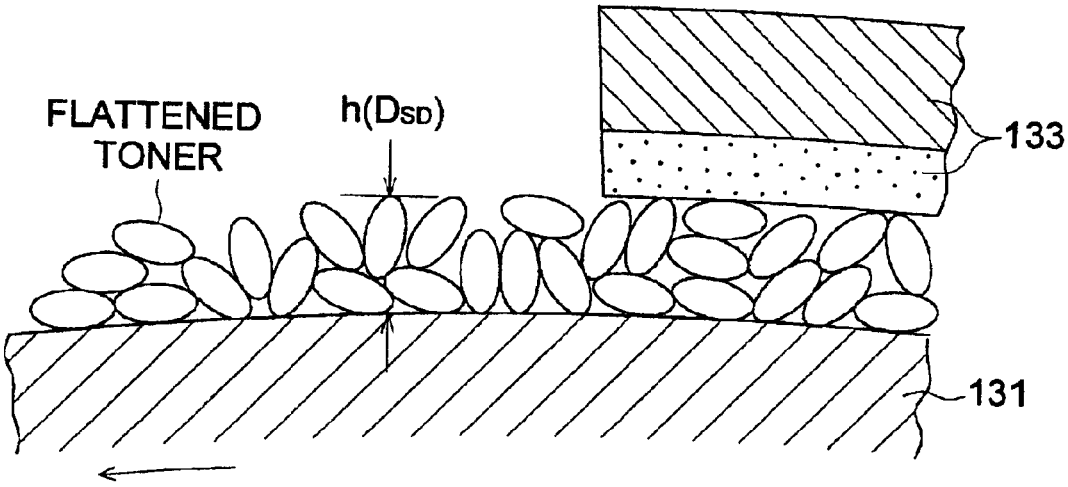

Especially in non-contact development, in the case where it is practiced such a control that the thickness of the toner layer h ($D_{SD}$) formed by the pressing of the layer thickness regulating member 133 is made to fall within a range of 1 to 1.5 layers and the flattened toner particles are made to adhere to the developing sleeve 131 with a coverage ratio falling within a range of 60 to 120%, flattened toner particles, which have been electro-statically adhering to the surface of the developing sleeve with the flattened portion as shown in FIG. 13(*a*) in the development region, are detached from the developing sleeve 131 by the applied electric bias voltage, and the flattened toner particles fly to adhere to the latent image area of the photoreceptor drum 10 with the flattened portion brought in contact with its surface as shown in FIG. 12(*c*); thus, a development to form a thin layer giving a sufficient image density is carried out. In such a development, it is extremely effective to use an external additive explained in the foregoing, for raising the developing capability and forming a high-quality toner image of a thin layer.

Further, as shown in FIG. 13(*b*), in the case where the layer thickness h ($D_{SD}$) is made to take a larger value, the state of the flattened toner particles adhering to the developing sleeve 131 is disturbed, and the state of toner particles being charged and the charging potential are dispersed, which produces more toner scattering and makes it impossible to carry out a good development.

(Contact Development)

A developing device for practicing contact development comprises a developing sleeve 131 as a developer carrying member having its outer circumferential surface made of an elastic rubber material, and a layer thickness regulating member 133 made of a metallic plate; flattened toner particles, which have been conveyed in between the developing sleeve 131 and the layer thickness regulating member 133 in a state of being in lightly pressed contact with the both, form a layer having a thickness h ($D_{SD}$) of 1 to 1.5 layers while being subjected to frictional charging, and are conveyed to the developing region with their posture kept in such a way that the flattened portions are made to adhere to the developing sleeve 131. Because the flattened toner particles are charged frictionally from the both sides while they pass the layer thickness regulating site, a good charging can be performed as long as the layer thickness falls within a range of 1 to 1.5 layers.

In the developing region, the developing sleeve is kept in sliding contact with the photoreceptor drum 10 as being subjected to a slight elastic deformation, and the flattened toner particles, which have been adhering to the developing sleeve 131 with their flattened portion, attach to the latent image area on the photoreceptor drum 10 with their flattened portion brought into contact with its surface; thus, development is performed.

It is preferable that the position of the developing sleeve 131 coming close to the photoreceptor drum 10 is such that the direction of gravity is directed towards the developing sleeve 131 for the reason of preventing the scattering of toner particles etc., but of course, it is not limited to this. Further, for the developing sleeve, the outer diameter of 10 to 30 mm is preferably used, and it is preferable that the speed and the direction of the rotation of the developing sleeve 131 is slow and against the moving direction of the photoreceptor drum 10, from the view point of preventing the scattering of toner particles etc; however, from the view point of image reproducibility of the developing layer, it is preferable that the rotating direction is with the moving direction of the photoreceptor drum 10, and the circumferential speed of the developing sleeve 131 is suppressed within 1.5 to 3.5 times the circumferential speed of the photoreceptor drum 10. However, it is not limited to this. In contact development too, it is practiced to apply a voltage composed of a direct-current voltage and an alternate-current voltage superposed to the developing sleeve 131. For the direct current component of the bias voltage, in reverse development, it is set at a value smaller than the accepted charge potential in the background area having no image of the photoreceptor drum 10 by about 100 to 200 V. For the alternate current component, a voltage falling within a range of the frequency 1 to 5 kHz and the amplitude $V_{PP}$ 500 to 1,500 V is used. In contact development too, by the application of an alternate current bias voltage, the development efficiency is raised owing to the effect of the oscillating electric field, and by releasing the aggregation of the developer, it is prevented the production of an image in which the toner particles are brushed to get together towards the edge portion of the solid areas; further, flattened toner particles adhere to the photoreceptor drum with their flattened portion kept in contact with its surface, which makes it possible to perform a good development to produce an image having a high density without unevenness.

Also in contact development, in the case where a flattened toner is controlled in such a way that the toner particles adhere to the developing sleeve 131 with a coverage ratio falling within a range of 60 to 120%, flattened toner particles electrostatically adhere to the developing sleeve 131 with the flattened portion kept in contact with it as shown in FIG. 13(*a*), and in the development region, they are brought into frictional contact with the surface of the photoreceptor; by the application of the developing bias voltage, the flattened toner particles are attached on the latent image area of the photoreceptor drum 10 with the flattened portion brought into contact with its surface as shown in FIG. 12(*b*); thus, a development to deposit a thin layer giving a sufficient image density is carried out. In such a development, it is extremely effective to use an external additive explained in the foregoing, for raising the developing capability and forming a high-quality toner image of a thin layer.

Any one of the structures of the present invention is an image forming method which uses a flattened toner for a toner of a single-component developer and has the excellent effect that a high-density image can be obtained with a small amount of toner consumption and a high-quality image with little ruggedness and no toner scattering can be obtained; the effect that an excellent image is formed by using a flattened toner is actualized by the following:

(1) regulating the posture of flattened toner particles in adhering;

(2) using an external additive having a proper charging property;

(3) using an external additive of a proper size in a proper state of adhesion;

(4) practicing a proper treatment in preparing a flattened toner; and (5) controlling the distribution in the shape factors of a flattened toner properly.

In FIG. 8, each of the developing devices 13 contains inside a two-component developer (also a single-component developer is appropriate) of yellow (Y), magenta (M), cyan (C), or black (K) (a developer comprising a flattened toner described in detail in the foregoing), and is provided with a cylindrical developing roller 13*a* as a developer carrying member formed of non-magnetic stainless steel or aluminum having, for example, a thickness of 0.5 to 1 mm and an outer diameter of 15 to 25 mm.

In the developing region, the developing roller 13*a* is kept in a non-contact state with a specified gap of, for example, 100 to 1,000 $\mu$m to the photoreceptor drum 10*a*, and is to be rotated in the direction such that it moves in the direction with the moving direction of the photoreceptor drum 10 at the position where it is closest to the photoreceptor drum 10; in development, by the application of a development bias voltage composed of a direct current voltage of the same polarity as the toners (negative polarity in this embodiment) or a direct current voltage with an alternate current voltage AC superposed to the developing roller 13*a*, non-contact reverse development is carried out for the exposed area of the photoreceptor drum 10*a*. The accuracy of the developing gap is required to be 20 $\mu$m or under so as to prevent the unevenness of density in the image.

As explained in the above, by the developing device 13, an electrostatic latent image on the photoreceptor drum 10*a* to be formed through the charging by the scorotron charging device 11 and the image exposure (image writing) by the exposure optical system 12*a* is reversely developed in a non-contact state with a toner of the same polarity as the polarity of the charge on the photoreceptor 10*a* (In this embodiment, because the photoreceptor drum is negatively charged, the toners are of negative polarity.).

In FIG. 9, opposite to the circumference of the photoreceptor drum 10, there is provided a developing device 13 storing inside a two-component developer composed of a negatively charged conductive toner and a magnetic carrier, and reverse development is practiced by a developing roller 13*a* as a rotary developer carrying member with the developer held by a magnet member built inside.

The developer has a carrier composed of a ferrite core whose surface is coated with insulating resin and a flattened toner described in detail in the foregoing mixed together, and is carried to the developing region after it is regulated to a layer thickness of 0.1 to 0.6 mm on the developing roller 13*a*.

The gap of the developing roller 13*a* to the photoreceptor drum 10 in the developing region is kept at 0.2 to 1.0 mm which is larger than the thickness of the developer layer, and a bias voltage composed of a direct current voltage $V_{DC}$ and an alternate current voltage $V_{AC}$ superposed is applied between the developing roller 13*a* and the photoreceptor drum 10. Because the toner charge is of the same polarity as the direct current voltage $V_{DC}$ (negative), flattened toner particles which are given a chance to be detached from carrier particles by the alternate current voltage $V_{AC}$ are not attached on the area having an electric potential $V_H$ whose absolute value is larger than that of the direct current voltage $V_{DC}$, but attached on the area having an electric potential $V_L$ whose absolute value is smaller than that of $V_{DC}$ to an amount in accordance with the potential difference to make the latent image visible (to form a toner image composed of flattened toner particles by reverse development). Further, also it is appropriate to apply only a direct current voltage $V_{DC}$ between the developing roller 13*a* and the photoreceptor drum 10. In addition, it is of no problem to employ a contact development method for the development. This toner image composed of flattened toner particles is transferred onto a transfer belt 14*a* at the transfer site. The residual toner particles remaining on the photoreceptor drum 10 after transfer process are subjected to cleaning by a photoreceptor drum cleaning device 19 to carry out the collection of toner particles in a electrostatic way.

The volume-average particle diameter of the flattened toner particle is preferably 3 to 10 μm, and more preferably 4 to 9 μm.

It is preferable that the flattened toner particles have a specified shape. That is, it is preferable that the average lengths, which are the major axis ($r_1$) and the minor axis ($r_2$) of the cross-section perpendicular to the crushing direction of the average particle in a flattened toner, are both 5 to 20 μm, and the average thickness (d) is 1 to 5 μm. The ratio of the minor axis to the major axis ($r_2/r_1$) of the average cross-section is preferably 0.6 to 1.0, and more preferably, 0.8 to 1.0. The ratio of the average thickness of the toner particles to the average minor axis ($d/r_2$) is preferably 0.1 to 0.5, and more preferably, 0.2 to 0.4.

Actually, in the case where a color image (printed area ratio 25%) is formed by the above-mentioned image forming apparatus by using such a flattened toner, a high-density image having no ruggedness can be obtained even with an amount of toner consumption per one sheet of A4-size print which is as remarkably small as 20 to 40 mg, and an image without toner scattering having a printing-like quality can be obtained.

If the average lengths ($r_1$, $r_2$) of a flattened toner are smaller than 5 μm, there is a possible risk of an operator suffering from a disease such as pneumoconiosis, which is not preferable from the view point of safety and sanitation; if they exceed 20 μm, developing capability is lowered, and development of high fidelity cannot be carried out with the resolution of the developed image lowered, which is not preferable.

If the ratio ($r_2/r_1$) of the minor axis to the major axis of the average cross-section is smaller than 0.8, and in particular, if it is smaller than 0.6, the flattened portion of the flattened toner particles becomes difficult to attach facing the image forming member, the toner particles are difficult to deposit layer-wise, and the toner layer becomes thick, which makes the amount of toner consumption larger; on top of it, also in transfer and fixing processes, toner scattering and the spreading of toner particles become remarkable, which is not preferable.

If the average thickness (d) of a flattened toner is smaller than 1 μm, the flattened toner particles are broken during development to produce super-fine particles, which becomes the cause of producing toner scattering and background density; this is not preferable. If it exceeds 5 μm, toner particles are difficult to deposit layer-wise in development, to make the toner layer thicker, and the amount of toner consumption becomes larger, which is not preferable.

If the ratio of the average thickness to the average minor axis ($d/r_2$) of a flattened toner is not greater than 0.2, and in particular, smaller than 0.1, the flattened toner particles are broken during development, and super-fine particles are produced, which is not preferable to become the cause of producing toner scattering and background density. If it is not smaller than 0.4, and in particular, if it exceeds 0.5, the flattened portion of the flattened toner particles becomes difficult to attach facing the image forming member, the toner particles are difficult to deposit layer-wise, and the toner layer becomes thick, which makes the amount of toner consumption larger; these are not preferable. Further, also in transfer and fixing processes, toner scattering and the spreading of toner particles become remarkable, which is not preferable.

By making flattened toner particles have the above-mentioned shape, as described before in FIG. 11(*a*) to FIG. 11 (*c*), when a toner image is formed on an image forming member (photoreceptor drum) by carrying out development using a flattened toner, the flattened toner particles on the image forming member attach more layer-wise with the flattened portion facing the image forming member. Further, when being transferred from an image forming member to an intermediate transfer member (transfer belt), the flattened toner particles attach layer-wise with the flattened portion facing the intermediate transfer member. Especially in the case where a recording paper sheet is used for a transfer material (recording material), because a recording paper is made up of fibers and its surface has ruggedness, the surface portion and the inner portion are electrically non-uniform, and the variation of the electrical characteristics with humidity is also remarkable; therefore, there is a tendency that the state of adhesion of flattened toner particles is easily disturbed when they are transferred from an image forming member to a transfer material (recording paper), or from an intermediate transfer member to a transfer material (recording paper).

It can be considered because the state of charging on the surface of flattened toner particles is approximately uniform, and owing to it, Coulomb's force by the image forming member to the flattened portion of the flattened toner particles is stronger than that to the end portions of the flattened toner particles, that flattened toner particles adhere with the flattened portions brought into contact with the image forming member. It can be considered that, in this way, flattened toner particles are arrayed with their end portions laid down in the lateral direction on an image forming member or on an intermediate transfer member, become layer-wise because of the flattened portions being easy to superpose one another, and a stable toner image is kept even through being moved. Especially, in forming a color image, because toner images of the respective component colors are superposed, it becomes an important factor of the structure for obtaining a good image, to superpose the toner images of the respective component colors layer-wise with one flattened portion put on another on an image forming member or an intermediate transfer member having a flat and smooth surface and uniform electrical characteristics. It is a preferable structure of the method, to decrease the number of times of transfer onto a transfer material having a large variation of surface ruggedness and electrical characteristics, by carrying out the superposing of toner images frequently on an image forming member or on an intermediate transfer member.

It was observed that toner particles having an insufficient flattening ratio or toner particles having an indefinite shape had been brought in a state that the flattened portions are not uniformly laid down and particles are attached randomly and toner scattering and spreading of a toner image had became remarkable.

Further, even if a flattened toner was used, toner scattering and spreading of a toner image were observed in transfer process in a tandem-type apparatus in which each toner image is to be transferred onto a transfer material (recording paper), although they were not so remarkable as the case of a toner having an indefinite shape.

A toner composed of toner particles having an insufficient flattening ratio or toner particles having an indefinite shape means a toner composed of toner particles having a shape out of the above-mentioned specification for the shape of a flattened toner; a toner prepared by a pulverization method or a toner prepared without practicing a treatment for making the particles flattened in a polymerization method corresponds to this.

Figure 15:
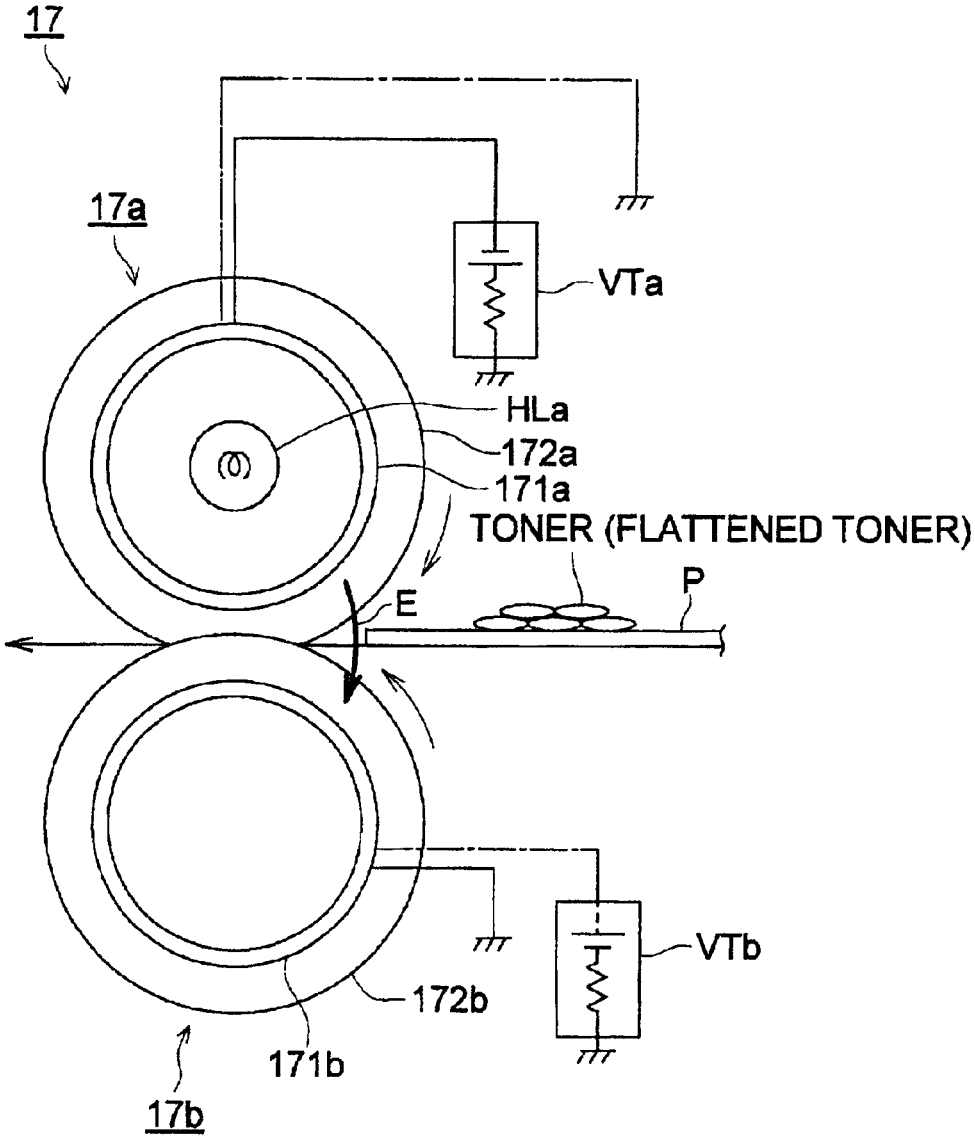
FIG. 15 is a cross-sectional view of an outline of a fixing device commonly used in each of the above-mentioned image forming apparatus.
Figure 17:
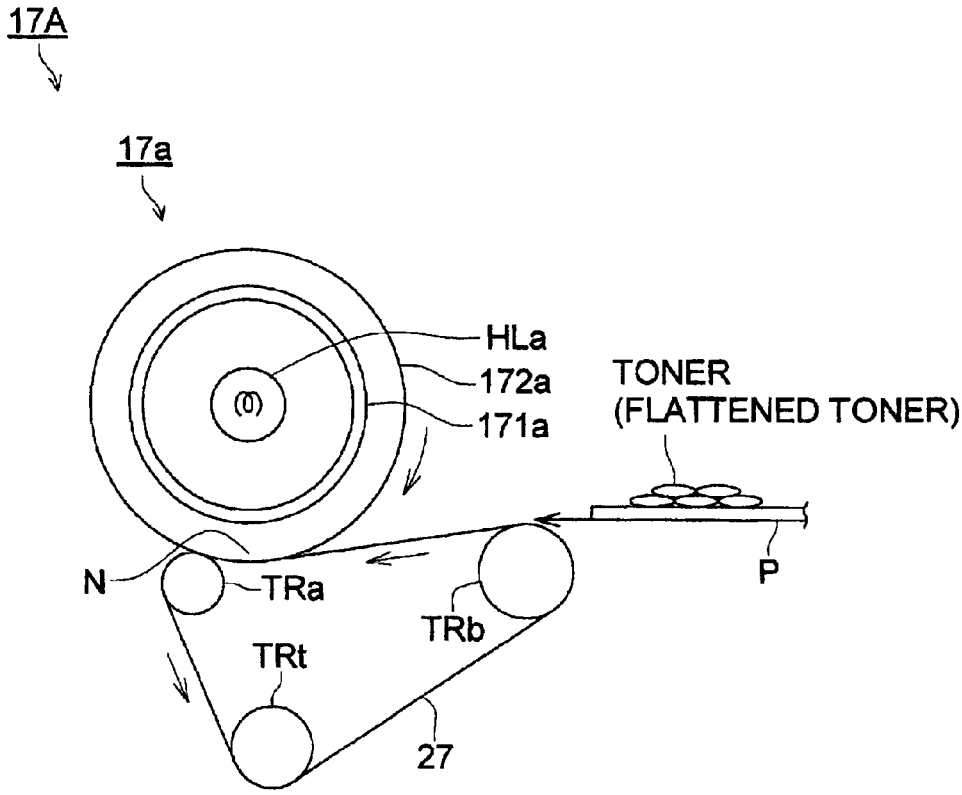
FIG. 17 is a drawing showing a first example of another structure of a fixing device.
Figure 18:
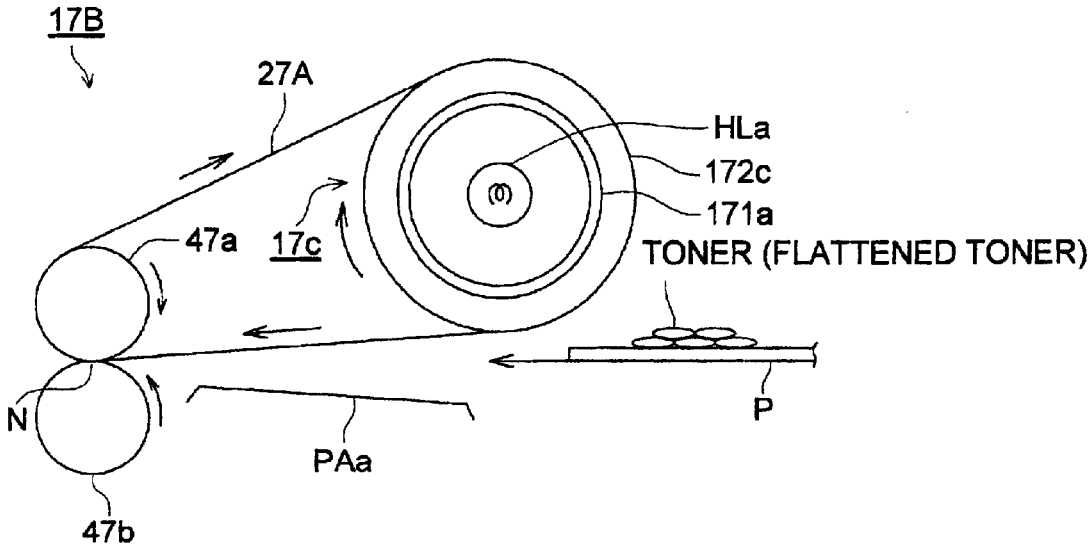
FIG. 18 is a drawing showing a second example of another structure of a fixing device.

How to prevent the disturbance of flattened toner particles on a transfer material at the time of fixing will be explained by using FIG. 15 to FIG. 18. FIG. 15 is a drawing showing an outlined cross-sectional view of a fixing device common to the above-mentioned various image forming apparatus, FIG. 16 is a drawing showing flattened toner particles on a transfer material under an electric field, FIG. 17 is a drawing showing a first example of another structure of a fixing device, and FIG. 18 is a drawing showing a second example of another structure of a fixing device.

Figure 16:
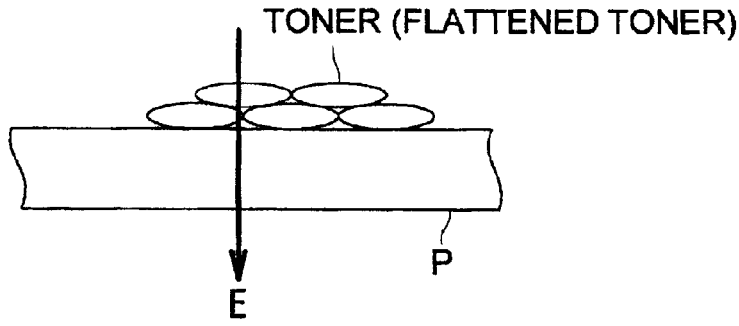
FIG. 16 is a drawing showing particles of a flattened toner on a transfer material under an electric field.

According to FIG. 15 or FIG. 16, as shown in FIG. 15, a fixing device 17 to be provided in the above-mentioned various image forming apparatus is composed of a fixing roller 17*a* as a fixing roller member (a roller member which is provided at the side to face a toner image on the transfer material) for fixing superposed color toner images composed of flattened toner particles, and a pressing roller 17*b* as a pressing roller member (a roller member which is provided at the side to face the surface of the transfer material having no toner image) provided opposite to the fixing roller 17*a*. At the central part of the inside of the fixing roller 17*a*, there is provided a halogen lamp HLa as a heating means having a heat generating filament (with no sign attached in the drawing) as a heat generating source, which heats the fixing roller 17*a*.

The fixing roller 17*a* has a structure as a somewhat softer soft roller having an outer diameter of 30 to 50 mm, which is formed of a cylindrical metallic pipe 171*a* made of, for example, an aluminum material, a stainless steel material, or the like having a thickness of 1 to 3 mm, and a rubber roller layer 172*a* made up of a somewhat softer rubber layer made of, for example, a silicone rubber material having a thin thickness of 2 to 5 mm and a rubber hardness of 10 Hs to 40 Hs (JIS, rubber hardness A) provided on the outer circumferential surface of said metallic pipe 171*a*. Further, the pressing roller 17*b* has a structure as a somewhat harder soft roller having an outer diameter of 30 to 50 mm, which is formed of a cylindrical metallic pipe 171*b* made of, for example, an aluminum material, a stainless steel material, or the like having a thickness of 1 to 3 mm, and a rubber roller layer 172*b* made up of a somewhat harder rubber layer made of, for example, a silicone rubber material having a thin thickness of 2 to 5 mm and a rubber hardness of 20 Hs to 50 Hs (JIS, rubber hardness A) provided on the outer circumferential surface of said metallic pipe 171*b*.

Between the fixing roller 17*a* formed as a somewhat softer soft roller and the pressing roller 17*b* formed as a somewhat harder soft roller, a nip portion N with its shape made convex towards the fixing roller is formed, where it is carried out the fixing of a toner image composed of flattened toner particles on a recording paper sheet P.

In transfer processing, a toner image composed of transferred flattened toner particles are attached on the recording paper sheet P with the flattened portion brought into contact with the paper surface, and the toner layer is made thin and flat; however, because the recording paper sheet has ruggedness which makes flattened toner particles easy to stand up, and they tend to be scattered at the entrance of the nip portion N in fixing. In order to prevent this, a fixing bias voltage VTa of the same polarity as the polarity of the flattened toner on the recording paper sheet P (In the explanation of the embodiment of the above-mentioned various image forming apparatus, the polarity of flattened toner used is negative.) composed of, for example, a direct current voltage of negative polarity of −500 to −2,000 V is applied to the developing roller 17*a*, and the pressing roller is grounded, to form an electric field E between the fixing roller 17*a* and the pressing roller 17*b*; thus, as shown in FIG. 16, by the electrical action of the electric field E, the flattened toner particles are pressed with the flattened portion brought into pressing contact with the surface of the recording paper sheet P, so as not to produce the disturbance of the flattened toner particles, while the recording paper sheet P is made to enter the nip portion N, to fix the toner image composed of the flattened toner particles on the recording paper sheet P by heat and pressure (under the application of pressure) (The toner image is made to firmly attach on the recording paper sheet P.).

That is, an electric field is made to act, to press toner particles to a recording paper sheet P. By this electric field E, flattened toner particles which have been laid down beforehand are more stabilized. By applying an electric field E, flattened toner particles move so as to become laid down (Toner particles tend to adhere flat on the surface of the recording paper sheet P.).

Besides, as shown by the single dot and dash line in FIG. 15, also it is appropriate that a fixing bias voltage VTb of the reverse polarity to the polarity of the flattened toner on the recording paper sheet P (In the explanation of the embodiment of the above-mentioned various image forming apparatus, the polarity of flattened toner used is negative.) composed of, for example, a direct current voltage of positive polarity of +500 to +2,000 V is applied to the pressing roller 17*b*, and the developing roller is grounded, to form an electric field E between the fixing roller 17*a* and the pressing roller 17*b*; thus, by the electrical action of the electric field E, the flattened toner particles are pressed with the flattened portion brought into pressing contact with the surface of the recording paper sheet P, so as not to produce the disturbance of the flattened toner particles, while the recording paper sheet P is made to enter the nip portion N, to fix the toner image composed of the flattened toner particles on the recording paper sheet P (The toner image is made to firmly attach on the recording paper sheet P.).

As described in the above, because the toner layer is thin, it never happens that toner particles are crushed to spread, and no image disturbance occurs, even in fixing under a high pressure (Especially for superposed color toner images, a high pressure is required because toner disturbance become remarkable owing to the thick toner layer.). Further, a good fixing can be performed even with a narrow width of the nip portion N. Because it is possible to make the width of the nip portion N narrow, fixing can be done while much heat is not taken by the recording paper sheet P; therefore, fixing of a toner image can be done only by the heat of the fixing roller 17*a* which is heated by the halogen lamp HLa built inside, even if the heating from the side of the pressing roller 17*b* is insufficient. That is, up to now, nip portion with a broad width has been necessary owing to the thick toner layer, and also heating by the pressing roller 17*b* has been required; however, by making the toner layer thin by employing a flattened toner, fixing of a toner image by the heat of the fixing roller 17*a* only is enabled, and it becomes possible to make heating by the pressing roller 17*b* unnecessary. It is made possible to lower the proportion of the pressing roller 17*b* contributing to heating, and also it is made possible that the heat insulating ability of the pressing roller 17*b* is raised and the heat capacity is decreased.

As described in the above, by employing a developer including a flattened toner, it becomes possible to make the toner layer thinner and flat, the disturbance of flattened toner particles (toner image disturbance) at the time of fixing is prevented, the spreading of toner crushing is prevented, and occurrence of image disturbance is suppressed. On top of it, because the spreading of toner crushing is prevented, it becomes possible to make the width of nip portion narrower, and also it becomes possible to provide an image forming apparatus having a fixing device which enables the shortening of warm-up time.

In particular, in forming a color toner image in image forming apparatus shown in FIG. 8 to FIG. 10 respectively, by employing a developer including a flattened toner, it becomes possible to make a color toner image composed of toner layers superposed which tends to have a large toner layer thickness thinner and flat, it is prevented the disturbance of flattened toner particles (toner image disturbance) at the time of fixing for a color toner image composed of toner layers superposed which requires a high pressure owing to the thick layer, the spreading of toner crushing, which becomes broader owing to the thick layer, is prevented, and occurrence of image disturbance is suppressed. On top of it, because the spreading of toner crushing is prevented, it becomes possible to make the width of nip portion narrower (It becomes possible to make narrower the width of the nip portion, which requires a broader width owing to the thicker toner layer in the case of a color toner image composed of toner layers superposed.), and it becomes possible to provide an image forming apparatus having a fixing device which enables the shortening of warm-up time.

Further, as shown in FIG. 17, it is also appropriate that a fixing device 17A is made up of a fixing roller 17*a* composed of a halogen lamp HLa built inside and a metallic pipe 171*a* coated with a rubber roller layer 172*a* outside, a fixing belt 27 positioned opposite to the fixing roller 17*a* stretched around rollers for stretching TRa and TRb, both made as a hard roller made of a metal material, and a tension roller TRt. The fixing belt 27 is a conductive belt-shaped member made up of a semi-conductive film or a film coated with a conductive nickel film on its surface and is capable of application of an electric voltage.

Between the fixing roller 17*a* and the fixing belt 27, there is formed a nip portion N, where a toner image composed of a flattened toner on a recording paper sheet P is fixed.

In the same way as described before in FIG. 15, also it is appropriate that a bias voltage is applied between the fixing roller 17*a* and the fixing belt 27 to form an electric field E (refer to FIG. 15, not shown in FIG. 17), and by the action of the electric field E, flattened toner particles are pressed to the surface of the recording paper sheet P with the flattened portion kept in contact, and the recording paper sheet P is introduced into the nip portion N while the disturbance of the toner particles are not produced; thus, by the heat of the fixing roller 17*a* and the pressure caused by the tension of the fixing belt 27 (under the application of pressure), a toner image composed of flattened toner particles on the recording paper sheet P are fixed (firmly attached to the recording paper sheet P). By doing this, because the toner layer becomes thin at the time of fixing, it never happens that toner particles are crushed to spread, and image disturbance is not produced, even in the case where fixing is done under high pressure (Especially for a color toner image composed of toner layers superposed, toner disturbance is remarkable because of thick toner layer to require a high pressing force). Further, even if the width of the nip portion N is narrow, satisfactory fixing can be done. Because it is possible to make the width of the nip portion N narrow, heat is not to be taken by the recording paper sheet P, and even if the heating from the side of the fixing belt 27 is insufficient, fixing of a toner image is enabled by only the fixing roller 17*a* heated by the halogen lamp HLa built inside. That is, up to now, nip portion with a broad width has been necessary owing to the thick toner layer, and also heating from the fixing belt 27 has been required; however, by making the toner layer thin by employing a flattened toner, fixing of a toner image by the heat of the fixing roller 17*a* only is enabled, and it becomes possible to make heating by the fixing belt 27 unnecessary. It is made possible to lower the proportion of the fixing belt 27 contributing to heating.

In this way, it is preferable to use the above-mentioned flattened toner, for the toner which is expected to exhibit the effect of the application of a bias voltage at the time of fixing.

As described in the above, by employing a developer including a flattened toner, it becomes possible to make the toner layer thinner and flat, the disturbance of flattened toner particles (toner image disturbance) at the time of fixing is prevented, the spreading of toner crushing is prevented, and occurrence of image disturbance is suppressed. On top of it, because the spreading of toner crushing is prevented, it becomes possible to make the width of nip portion narrower, and it becomes possible to provide an image forming apparatus having a fixing device which enables the shortening of warm-up time.

In particular, in forming a color toner image in image forming apparatus shown in FIG. 8 to FIG. 10 respectively, by employing a developer including a flattened toner, it becomes possible to make a color toner image composed of toner layers superposed which tends to have a large toner layer thickness thinner and flat, it is prevented the disturbance of flattened toner particles (toner image disturbance) at the time of fixing for a color toner image composed of toner layers superposed which requires a high pressure owing to the thick layer. The spreading of toner particle crushing, which becomes broader owing to the layer becoming thicker, is prevented, and occurrence of image disturbance is suppressed. On top of it, because the spreading of toner particle crushing, which becomes broader owing to the layer being thicker, is prevented, it becomes possible to make the width of nip portion narrower (It becomes possible to make narrower the width of the nip portion, which requires a broader width owing to the thicker toner layer in the case of a color toner image composed of toner layers superposed.), and it becomes possible to provide an image forming apparatus having a fixing device which enables the shortening of warm-up time.

Further, as shown in FIG. 18, it is also appropriate to make up a fixing device 17B of a fixing roller 17*c*, which comprises a halogen lamp HLa inside, and is composed of a metallic pipe 171*a* and a somewhat harder rubber roller layer 172*c* having a thickness as thin as 0.5 mm to 1.0 mm and a rubber hardness of 40 Hs to 60 Hs (JIS, rubber hardness A) on the outer surface of said metallic pipe, a first fixing roller 47*a* as a soft roller made of a somewhat softer rubber material, a fixing belt 27A stretched around said fixing roller 17*c* and said first fixing roller 47*a*, and a second fixing roller 47*b* which is positioned opposite to the first fixing roller 47*a* with the fixing belt 27A held in between. The fixing belt 27A is a conductive belt-shaped member made up of a semi-conductive film or a film coated with a conductive nickel layer, and is capable of application of an electric voltage.

A nip portion N is formed between the first fixing roller 47*a* as a somewhat softer soft roller and the second fixing roller 47*b* as a somewhat harder soft roller with the fixing belt 27A held in between, and it is fixed a toner image composed of flattened toner particles on a recording paper sheet P to be introduced into the nip portion N through a guide plate PAa.

In the same way as described before in FIG. 15, also it is appropriate that a bias voltage is applied between the first fixing roller 47*a* and the second fixing roller 47*b* to form an electric field E (refer to FIG. 15, not shown in FIG. 18), and by the action of the electric field E, flattened toner particles are pressed to the surface of the recording paper sheet P with the flattened portion kept in contact with the paper surface, to produce no disturbance of the toner particles while the recording paper sheet P is introduced into the nip portion N; thus, by the heat of the fixing belt 27A which is heated by the fixing roller 17*c* and the pressure caused by the first fixing roller 47*a* and the second fixing roller 47*b* (under the application of pressure by the first fixing roller 47*a* and the second fixing roller 47*b*), a toner image composed of flattened toner particles on the recording paper sheet P are fixed (firmly attached to the recording paper sheet P). By doing this, because the toner layer becomes thin at the time of fixing, it never happens that toner particles are crushed to spread, and image disturbance is not produced, even in the case where fixing is done under high pressure (Especially for a color toner image composed of toner layers superposed, toner disturbance is remarkable because of thick toner layer, to require a high pressing force). Further, even if the width of the nip portion N is narrow, satisfactory fixing can be done. Because it is possible to make the width of the nip portion N narrow, heat is not to be taken by the recording paper sheet P, and even if the heating from the side of the second fixing roller 47*b* is insufficient, fixing of a toner image is enabled by the heat of the fixing belt 27A heated by the first fixing roller 17*c* only. That is, up to now, nip portion with a broader width has been necessary owing to the thicker toner layer, and also heating from the first fixing roller 47*a* or the second fixing roller 47*b* has been required; however, by making the toner layer thinner by employing a flattened toner, fixing of a toner image by the heat of the fixing belt 27A heated by the first fixing roller 17*c* only is enabled, and it becomes possible to make the heating by the first fixing roller 47*a* and/or the second fixing roller 47*b* unnecessary. It is made possible to lower the proportion of the first fixing roller 47*a* and/or the second fixing roller 47*b* contributing to heating.

In this way, it is preferable to use the above-mentioned flattened toner for the toner which is expected to exhibit the effect of application of a bias voltage at the time of fixing.

According to the present invention, by employing a developer including a flattened toner, it becomes possible to make the layer of a toner image thinner and flat, while the disturbance of flattened toner particles (toner image disturbance) at the time of fixing is prevented, the spreading of toner particle crushing is prevented, and the generation of image disturbance is prevented. On top of it, because the spreading of toner particle crushing is prevented, it becomes possible to make the width of the nip portion narrower, and it becomes possible to provide an image forming apparatus comprising a fixing device which enables the shortening of warm-up time.

Further, by employing a developer including a flattened toner, it becomes possible to make a color toner image composed of toner layers superposed, which tends to have a large toner layer thickness, thinner and flat, and it is prevented the disturbance of flattened toner particles (toner image disturbance) at the time of fixing for a color toner image composed of toner layers superposed which requires a high pressure owing to the thick layer. The spreading of toner particle crushing, which becomes broader owing to the layer becoming thicker, is prevented, and occurrence of image disturbance is suppressed. On top of it, because the spreading of toner particle crushing, which becomes broader owing to the layer being thicker, is prevented, it becomes possible to make the width of nip portion narrower (It becomes possible to make narrower the width of the nip portion, which requires a broader width owing to the thicker toner layer in the case of a color toner image composed of toner layers superposed.), and it becomes possible to provide an image forming apparatus having a fixing device which enables the shortening of warm-up time.

What is claimed is:

1. An image forming method comprising the steps of:

developing an electrostatic latent image on an image forming body employing a developing agent composed of flattened spheroidal toner particles to form a toner image;

transferring the toner image formed on the image forming body onto a transfer material; and fixing the toner image on the transfer material by one of a fixing device having a fixing roller having a heating means and a pressing roller, a fixing device having a fixing roller having a heating means and a pressure belt, and a fixing device having a fixing belt entrained between a fixing roller containing a heating means and a first fixing roller and a second fixing roller facing the first fixing roller through the fixing belt, wherein the flattened spheroidal toner particles satisfy the following conditions:

$r_2/r_1$ is not less than 0.6 and not more than 1.0;

$d/r_2$ is not less than 0.1 and not more than 0.5;

$r_2$ is not less than 5 $\mu$m and not more than 20 $\mu$m; and $r_1$ is not less than 5 $\mu$m and not more than 20 $\mu$m, wherein $r_1$ represents an average length of a major axis of each of the flattened toner particles, $r_2$ represents an average length of a minor axis of each of the flattened toner particles, and d represents an average thickness of each of the flattened toner particles, wherein the developing agent is a two-component developing agent composed of the flattened toner particles and carrier particles, each of the flattened toner particles is attached onto the image forming body in the developing step and the transfer material in the transferring step in such a manner that a surface perpendicular to a direction of the thickness of each of the flattened toner particles comes into contact with a surface of the image forming body and a surface of the transfer material.

2. The image forming method of claim 1, wherein an electric charge is applied to the flattened toner particles by a frictional charging with the carrier particles, each of the flattened toner particles is attached onto each of the carrier particles, and said developing step is conducted in a condition where a surface coverage ratio by a sectional area of a portion perpendicular to the direction of the thickness of each of the flattened toner particles to a surface area of each of the carrier particles is 40 to 80%.

3. The image forming method of claim 1, wherein the developing agent is a two-component developing agent composed of the flattened toner particles and carrier particles, said developing step is conducted in a condition where the flattened toner particles are attached to latent image portions on the image forming body and where external additives are attached to each of the flattened toner particles, a condition of $|Q'|>|Q|$ is satisfied wherein Q'($\mu$C/g) represents a charge quantity of the flattened toner particles with the external additives attached thereto and Q ($\mu$C/g) represents a charge quantity of the flattened toner particles without the external additives attached thereto, and a surface perpendicular to a direction of the thickness of each of the flattened toner particles is attached to a surface of the image forming body.

4. The image forming method of claim 3, wherein $|Q'|/|Q|$ is not less than 1.1 and not more than 1.5.

5. The image forming method of claim 3, wherein said developing step is conducted in such a manner that a surface coverage ratio of the external additives to a surface area of each of the flattened toner particles is 50 to 100%.

6. The image forming method of claim 1, wherein the developing agent is a two-component developing agent composed of the flattened toner particles and carrier particles, said developing step is conducted in condition where the flattened toner particles are attached to latent image portions on the image forming body and where a surface perpendicular to a direction of the thickness of each of the flattened toner particles is attached to a surface of the image forming body while external additives are attached to each of the flattened toner particles, and the following condition is satisfied, p/r is not more than 10-1 and not less than 5×10-3, wherein p represents a diameter of each of the particles of the external additives, r represents a diameter of each of the flattened toner particles.

7. The image forming method of claim 6, wherein p/d is not more than $3\times10^{-1}$ and not less than $3\times10^{-2}$, wherein d represents a thickness of each of the flattened toner particles.

8. The image forming method of claim 6, wherein an annexing amount of the external additives attached to the surface of the flattened toner particles is 0.1 to 5.0% by weight.

9. The image forming method of claim 6, wherein second external additives each having a diameter larger than each of said external additives are used with said external additives.

10. The image forming method of claim 1, wherein the developing agent is a two-component developing agent composed of the flattened toner particles and carrier particles, said developing step is conducted in a condition where a surface perpendicular to a direction of the thickness of each of the flattened toner particles is attached to latent image portions on the image forming body, the flattened toner particles are prepared by flattening-processing of spherical polymerization toner particles, and in a particle size distribution of the spherical polymerization toner particles for use in preparing the flattened toner particles, more than 80% of the spherical polymerization toner particles satisfy the following expression, $$\tfrac{1}{2}d_0/d_0(M)<2$$

wherein $d_0$ represents a diameter of each of the spherical toner particles, and $d_0$ (M) represents an average particle diameter of the spherical toner particles.

11. The image forming method of claim 10, wherein more than 95% of the spherical polymerization toner particles satisfy the following expression, $$\tfrac{1}{2}<d_0/d_0(M)<2.$$

12. The image forming method of claim 1, wherein the developing agent is a two-component developing agent composed of the flattened toner particles and carrier particles, said developing step is conducted in a condition where a surface perpendicular to a direction of the thickness of each of the flattened toner particles is attached to latent image portions on the image forming body, and in a ratio distribution of a thickness d to a diameter r of each of the flattened toner particles, more than 80% of the flattened toner particles satisfy the following expression, $$\tfrac{1}{2}<(d/r)/(d/r)(M)<<2,$$

wherein (d/r) (M) represents an average ratio of the thickness d to the diameter r of the flattened toner particles.

13. The image forming method of claim 12, wherein more than 95% of the flattened toner particles satisfy the following expression, $$\tfrac{1}{2}<(d/r)/(d/r)(M)<<2.$$

14. An image forming method comprising the steps of:

developing an electrostatic latent image on an image forming body employing a developing agent composed of flattened spheroidal toner particles to form a toner image;

transferring the toner image formed on the image forming body onto a transfer material; and fixing the toner image on the transfer material by one of a fixing device having a fixing roller having a heating means and a pressing roller, a fixing device having a fixing roller having a heating means and a pressure belt, and a fixing device having a fixing belt entrained between a fixing roller containing a heating means and a first fixing roller and a second fixing roller facing the first fixing roller through the fixing belt, wherein the flattened spheroidal toner particles satisfy the following conditions:

$r_2/r_1$ is not less than 0.6 and not more than 1.0;

$d/r_2$ is not less than 0.1 and not more than 0.5;

$r_2$ is not less than 5 $\mu$m and not more than 20 $\mu$m; and $r_1$ is not less than 5 $\mu$m and not more than 20 $\mu$m, wherein $r_1$ represents an average length of a major axis of each of the flattened toner particles, $r_2$ represents an average length of a minor axis of each of the flattened toner particles, and d represents an average thickness of each of the flattened toner particles, wherein the developing agent is a single-component developing agent composed of the flattened toner particles, each of the flattened toner particles is attached onto the image forming body in the developing step and the transfer material in the transferring step in such a manner that a surface perpendicular to a direction of the thickness of each of the flattened toner particles comes into contact with a surface of the image forming body and a surface of the transfer material.

15. The image forming method of claim 14, wherein an electric charge is applied to the flattened toner particles by a frictional charging between a developing sleeve and a pressing member in a developing device, each of the flattened toner particles is attached onto the developing sleeve in a condition where the surface perpendicular to the direction of the thickness of each of the flattened toner particles comes into contact with a surface of the developing sleeve, and said developing step is conducted in such a manner that a surface coverage ratio by a sectional area of a portion perpendicular to the direction of the thickness of each of the flattened toner particles to a surface area of the developing sleeve is 60 to 120%.

16. The image forming method of claim 14, wherein the developing agent is a single-component developing agent composed of the flattened toner particles, said developing step is conducted in condition where the flattened toner particles are attached to latent image portions on the image forming body and where external additives are attached to each of the flattened toner particles, a condition of $|Q'||Q|$ is satisfied wherein Q' ($\mu$C/g) represents a charging amount of the flattened toner particles with the external additives attached thereto and Q ($\mu$C/g) represents a charging amount of the flattened toner particles without the external additives attached thereto, and a surface perpendicular to a direction of the thickness of each of the flattened toner particles is attached to a surface of the image forming body.

17. The image forming method of claim 16, wherein $|Q'|/|Q|$ is not less than 1.1 and not more than 1.5.

18. The image forming method of claim 16, wherein said developing step is conducted in such a manner that a surface coverage ratio of the external additives to a surface area of each of the flattened toner particles is 50 to 100%.

19. The image forming method of claim 14, wherein the developing agent is a single-component developing agent composed of the flattened toner particles, said developing step is conducted in condition where the flattened toner particles are attached to latent image portions on the image forming body and where a surface perpendicular to a direction of the thickness of each of the flattened toner particles is attached to a surface of the image forming body while external additives are attached to each of the flattened toner particles, and the following condition is satisfied, p/r is not more than $10^{-1}$ and not less than $5\times10^{-3}$, wherein p represents a diameter of each of the particles of the external additives, r represents a diameter of each of the flattened toner particles.

20. The image forming method of claim 19, wherein p/d is not more than $3\times10^{-1}$ and not less than $3\times10^{-2}$, wherein d represents a thickness of each of the flattened toner particles.

21. The image forming method of claim 19, wherein an annexing amount of the external additives attached to the surface of the flattened toner particles is 0.1 to 5.0% by weight.

22. The image forming method of claim 19, wherein second external additives each having a diameter larger than each of said external additives are used with said external additives.

23. An image forming method comprising the steps of:

developing an electrostatic latent image on an image forming body employing a developing agent composed of flattened spheroidal toner particles to form a toner image;

transferring the toner image formed on the image forming body onto a transfer material; and fixing the toner image on the transfer material by one of a fixing device having a fixing roller having a heating means and a pressing roller, a fixing device having a fixing roller having a heating means and pressure belt, and a fixing device having a fixing belt entrained between a fixing roller containing a heating means and a first fixing roller and a second fixing roller facing the first fixing roller through the fixing belt, wherein the flattened spheroidal toner particles satisfy the following conditions:

$r_2/r_1$ is not less than 0.6 and not more than 1.0;

$d/r_2$ is not less than 0.1 and not more than 0.5;

$r_2$ is not less than 5 $\mu$m and not more than 20 $\mu$m; and $r_1$ is not less than 5 $\mu$m and not more than 20 $\mu$m, wherein $r_1$ represents an average length of a major axis of each of the flattened toner particles, $r_2$ represents an average length of a minor axis of each of the flattened toner particles, and d represents an average thickness of each of the flattened toner particles, wherein said fixing step comprises:

forming an electric field in the fixing device in such a manner that a surface perpendicular to a direction of the thickness of each of the flattened toner particles comes into contact with a surface of the transfer material; and fixing the flattened toner particles attached to the transfer material thereon while applying pressure to the transfer material.

24. The image forming method of claim 23, wherein said developing step comprises repeating of the developing of the latent image to form toner images, the image forming method further comprising the step of superimposing the toner images on the image forming body to form a color toner image, said transferring step comprises transferring collectively the color toner image formed on the image forming body onto the transfer material.

25. The image forming method of claim 23, wherein said developing step comprises developing each of latent images formed on respective image forming bodies of plural image forming units which are arranged on an intermediate transfer body to form toner images, in which different colored toners are contained in each unit, said transferring step comprises transferring and superimposing successively the toner images formed on the respective image forming bodies onto the intermediate transfer body to form a color toner image, and then transferring collectively the color toner image onto the transfer material.

* * * * *